US007990066B2

(12) United States Patent
Kim et al.

(10) Patent No.: US 7,990,066 B2
(45) Date of Patent: Aug. 2, 2011

(54) PLASMA DISPLAY PANEL AND PLASMA DISPLAY APPARATUS WITH PHOSPHOR INCLUDING MAGNESIUM OXIDE

(75) Inventors: Heekwon Kim, Gumi (KR); Suho Bae, Gumi (KR); Jongjin Jeong, Gumi (KR); Sangsub Ha, Gumi (KR)

(73) Assignee: LG Electronics Inc., Seoul (KR)

( * ) Notice: Subject to any disclaimer, the term of this patent is extended or adjusted under 35 U.S.C. 154(b) by 389 days.

(21) Appl. No.: 11/931,761

(22) Filed: Oct. 31, 2007

(65) Prior Publication Data

US 2009/0009078 A1 Jan. 8, 2009

(30) Foreign Application Priority Data

Jul. 3, 2007 (KR) ..... 10-2007-0066531

(51) Int. Cl.
*H01J 17/49* (2006.01)

(52) U.S. Cl. ..... 313/582; 313/486

(58) Field of Classification Search ..... 313/582, 313/587, 486

See application file for complete search history.

(56) References Cited

U.S. PATENT DOCUMENTS

| | | | | |
|---|---|---|---|---|
| 2003/0146701 | A1* | 8/2003 | Kawamura et al. | 313/582 |
| 2004/0169474 | A1 | 9/2004 | Hampden-Smith et al. | |
| 2004/0239245 | A1* | 12/2004 | Kawamura et al. | 313/582 |
| 2005/0110412 | A1 | 5/2005 | Lee | |

FOREIGN PATENT DOCUMENTS

| | | | | |
|---|---|---|---|---|
| CN | 2594964 | Y | | 12/2003 |
| JP | 05051577 | A | * | 3/1993 |
| JP | 10-125240 | | | 5/1998 |
| JP | 11-043670 | | | 2/1999 |
| JP | 11043670 | A | * | 2/1999 |
| JP | 2004-207047 | | | 7/2004 |
| KR | 10-2005-0113804 | A | | 12/2005 |
| KR | 10-2006-0081606 | A | | 7/2006 |

OTHER PUBLICATIONS

PCT International Search Report and Written Opinion dated Apr. 10, 2008.

Chinese Office Action dated Mar. 5, 2010 for Application No. 200780010278.5.

European Search Report for Application 07860824 dated Jul. 19, 2010.

* cited by examiner

*Primary Examiner* — Karabi Guharay

(74) *Attorney, Agent, or Firm* — KED & Associates LLP

(57) ABSTRACT

A plasma display panel and a plasma display apparatus are disclosed. The plasma display panel includes a front substrate, a rear substrate positioned to be opposite to the front substrate, a barrier rib positioned between the front substrate and the rear substrate to partition a discharge cell, and a phosphor layer positioned inside the discharge cell. The phosphor layer includes a first phosphor layer emitting red light, a second phosphor layer emitting blue light, and a third phosphor layer emitting green light. The first phosphor layer includes a red pigment. At least one of the first phosphor layer, the second phosphor layer or the third phosphor layer includes magnesium oxide (MgO) material.

20 Claims, 18 Drawing Sheets

| | Phosphor material | Pigment | Oxide material |
|---|---|---|---|
| First phosphor layer | First phosphor material(Y,Gd)BO:Eu | Red pigment (Fe) | MgO |
| Second phosphor layer | Second phosphor material (Ba,Sr,Eu)$MgAl_{10}O_{17}$ | Blue pigment (Co) | MgO |
| Third phosphor layer | Third phosphor material ($Zn_2SiO_4:Mn^{2+}$ $YBO_3:Tb^{3+}$) | | MgO |

| | Comparative example | Experimental example 1 | Experimental example 2 | Experimental example 3 |
|---|---|---|---|---|
| Firing voltage | 135V | 128V | 129V | 127V |
| Luminance | 170(cd/m$^2$) | 176(cd/m$^2$) | 178(cd/m$^2$) | 177(cd/m$^2$) |
| Bright room CR | 55:1 | 60:1 | 58:1 | 61:1 |

FIG. 6

| R1/ R2 | Luminance | Difficulty level in process |
|---|---|---|
| 0.001 | ◎ | X |
| 0.003 | ◎ | X |
| 0.005 | ◎ | ○ |
| 0.007 | ◎ | ○ |
| 0.01 | ◎ | ○ |
| 0.03 | ◎ | ○ |
| 0.05 | ◎ | ◎ |
| 0.07 | ◎ | ◎ |
| 0.1 | ◎ | ◎ |
| 0.125 | ◎ | ◎ |
| 0.15 | ◎ | ◎ |
| 0.175 | ◎ | ◎ |
| 0.2 | ◎ | ◎ |
| 0.225 | ◎ | ◎ |
| 0.25 | ◎ | ◎ |
| 0.275 | ○ | ◎ |
| 0.3 | ○ | ◎ |
| 0.4 | ○ | ○ |
| ⋮ | ⋮ | ⋮ |
| 1.0 | ○ | ○ |
| 1.1 | X | X |

| | Phosphor material | Pigment | Oxide material |
|---|---|---|---|
| First phosphor layer | First phosphor material(Y,Gd)BO:Eu | Red pigment (Fe) | MgO |
| Second phosphor layer | Second phosphor material (Ba,Sr,Eu)$MgAl_{10}O_{17}$ | Blue pigment (Co) | MgO |
| Third phosphor layer | Third phosphor material ($Zn_2SiO_4$:$Mn^{2+}$ $YBO_3$:$Tb^{3+}$) | Green pigment (Zn) | MgO |

| Content of green pigment | Reflectance |
|---|---|
| 0 | 28% |
| 0.01 | 26.5% |
| 0.05 | 26.2% |
| 0.1 | 26% |
| 0.2 | 25.9% |
| 2.5 | 24.3% |
| 3 | 24% |
| 4 | 23.8% |
| 5 | 23.5% |
| 7 | 22.8% |

PLASMA DISPLAY PANEL AND PLASMA DISPLAY APPARATUS WITH PHOSPHOR INCLUDING MAGNESIUM OXIDE

This application claims the benefit of Korean Patent Application No. 10-2007-0066531 filed on Jul. 3, 2007 which is hereby incorporated by reference.

BACKGROUND OF THE DISCLOSURE

1. Field of the Disclosure

This document relates to a plasma display panel and a plasma display apparatus.

2. Description of the Related Art

A plasma display apparatus includes a plasma display panel.

The plasma display panel includes a phosphor layer inside discharge cells partitioned by barrier ribs and a plurality of electrodes.

A driving signal is supplied to the electrodes, thereby generating a discharge inside the discharge cells. When the driving signal generates a discharge inside the discharge cells, a discharge gas filled inside the discharge cells generates vacuum ultraviolet rays, which thereby cause phosphors formed inside the discharge cells to emit light, thus displaying an image on the screen of the plasma display panel.

SUMMARY OF THE DISCLOSURE

In one aspect, a plasma display panel comprises a front substrate, a rear substrate positioned to be opposite to the front substrate, a barrier rib that is positioned between the front substrate and the rear substrate and partitions a discharge cell, and a phosphor layer positioned inside the discharge cell, the phosphor layer including a first phosphor layer emitting red light, a second phosphor layer emitting blue light, and a third phosphor layer emitting green light, wherein the first phosphor layer includes a red pigment, and at least one of the first phosphor layer, the second phosphor layer or the third phosphor layer includes magnesium oxide (MgO) material.

In another aspect, a plasma display panel comprises a front substrate, a rear substrate positioned to be opposite to the front substrate, a barrier rib that is positioned between the front substrate and the rear substrate and partitions a discharge cell, and a phosphor layer positioned inside the discharge cell, the phosphor layer including a phosphor material, a pigment and magnesium oxide (MgO) material, wherein at least one of particles of the phosphor material is exposed on the surface of the phosphor layer in a direction toward the discharge cell.

In still another aspect, a plasma display apparatus comprises a front substrate including a scan electrode and a sustain electrode positioned parallel to each other, a rear substrate on which an address electrode is positioned to intersect the scan electrode and the sustain electrode, a barrier rib that is positioned between the front substrate and the rear substrate and partitions a discharge cell, and a phosphor layer positioned inside the discharge cell, the phosphor layer including a first phosphor layer emitting red light, a second phosphor layer emitting blue light, and a third phosphor layer emitting green light, wherein the first phosphor layer includes a red pigment, at least one of the first phosphor layer, the second phosphor layer or the third phosphor layer includes magnesium oxide (MgO) material, and a first sustain signal is supplied to the scan electrode and a second sustain signal overlapping the first sustain signal is supplied to the sustain electrode during a sustain period of at least one subfield of a frame.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings:

FIG. 6 illustrates the particle size of an oxide material;

DETAILED DESCRIPTION OF EMBODIMENTS

Reference will now be made in detail embodiments of the invention examples of which are illustrated in the accompanying drawings.

Figure 1A:
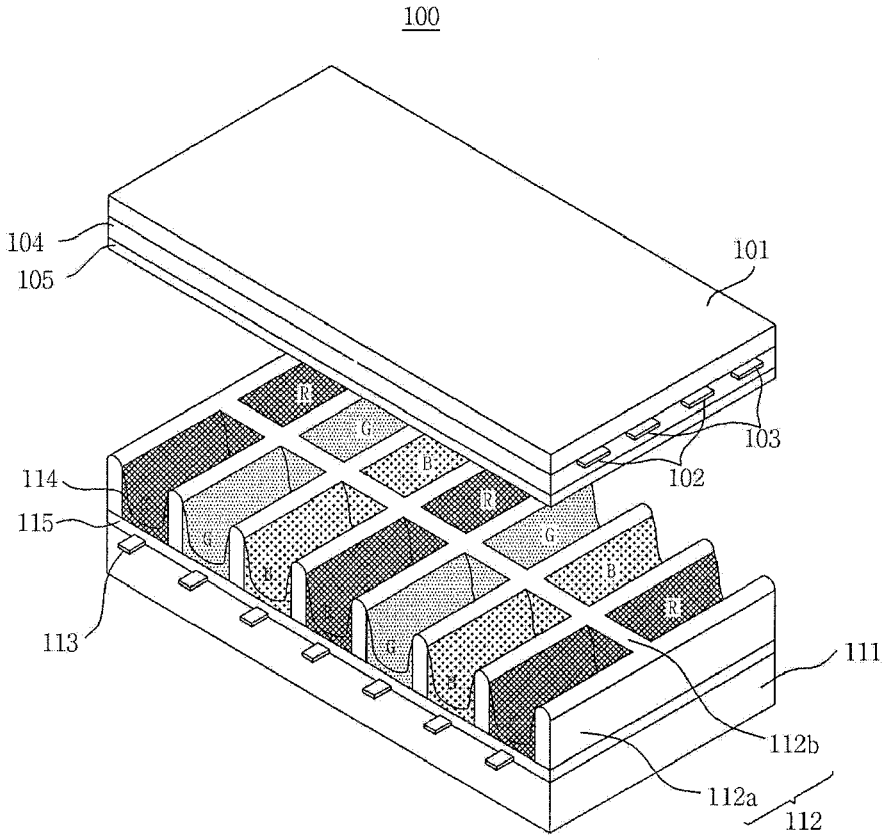
FIGS. 1A and 1B illustrate a structure of a plasma display panel according to an exemplary embodiment.
Figure 1B:
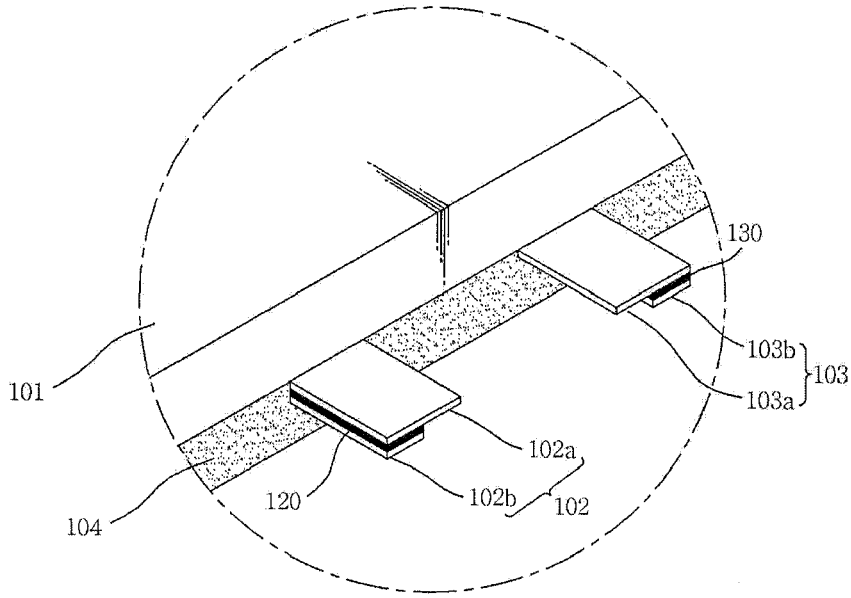

FIGS. 1A and 1B illustrate a structure of a plasma display panel according to an exemplary embodiment.

As illustrated in FIG. 1A, a plasma display panel 100 according to an exemplary embodiment includes a front substrate 101 and a rear substrate 111 which coalesce with each other. On the front substrate 101, a scan electrode 102 and a sustain electrode 103 are positioned parallel to each other. On the rear substrate 111, an address electrode 113 is positioned to intersect the scan electrode 102 and the sustain electrode 103.

An upper dielectric layer 104 is positioned on the scan electrode 102 and the sustain electrode 103 to provide electrical insulation between the scan electrode 102 and the sustain electrode 103.

A protective layer 105 is positioned on the upper dielectric layer 104 to facilitate discharge conditions. The protective layer 105 may include a material having a high secondary electron emission coefficient, for example, magnesium oxide (MgO).

A lower dielectric layer 115 is positioned on the address electrode 113 to provide electrical insulation of the address electrodes 113.

Barrier ribs 112 of a stripe type, a well type, a delta type, a honeycomb type, and the like, are positioned on the lower dielectric layer 115 to partition discharge spaces (i.e., discharge cells). A red (R) discharge cell, a green (G) discharge cell, and a blue (B) discharge cell, and the like, may be positioned between the front substrate 101 and the rear substrate 111. In addition to the red (R), green (G), and blue (B) discharge cells, a white (W) discharge cell or a yellow (Y) discharge cell may be positioned.

Each discharge cell partitioned by the barrier ribs 112 is filled with a discharge gas including xenon (Xe), neon (Ne), and so forth.

A phosphor layer 114 is positioned inside the discharge cells to emit visible light for an image display during the generation of an address discharge. For instance, first, second and third phosphor layer respectively emitting red (R), blue (B) and green (G) light may be positioned inside the discharge cells. In addition to the red (R), green (G) and blue (B) light, a phosphor layer emitting white or yellow light may be positioned.

A thickness of at least one of the phosphor layers 114 formed inside the red (R), green (G) and blue (B) discharge cells may be different from thicknesses of the other phosphor layers. For instance, thicknesses of the second and third phosphor layers inside the blue (B) and green (G) discharge cells may be larger than a thickness of the first phosphor layer inside the red (R) discharge cell. The thickness of the second phosphor layer may be substantially equal or different from the thickness of the third phosphor layer.

Widths of the red (R), green (G), and blue (B) discharge cells may be substantially equal to one another. Further, a width of at least one of the red (R), green (G), or blue (B) discharge cells may be different from widths of the other discharge cells. For instance, a width of the red (R) discharge cell may be the smallest, and widths of the green (G) and blue (B) discharge cells may be larger than the width of the red (R) discharge cell. The width of the green (G) discharge cell may be substantially equal or different from the width of the blue (B) discharge cell. Hence, a color temperature of an image displayed on the plasma display panel can be improved.

The plasma display panel 100 may have various forms of barrier rib structures as well as a structure of the barrier rib 112 illustrated in FIG. 1A. For instance, the barrier rib 112 includes a first barrier rib 112*b* and a second barrier rib 112*a*. The barrier rib 112 may have a differential type barrier rib structure in which heights of the first and second barrier ribs 112*b* and 112*a* are different from each other.

In the differential type barrier rib structure, a height of the first barrier rib 112*b* may be smaller than a height of the second barrier rib 112*a*.

While FIG. 1A has been illustrated and described the case where the red (R), green (G) and blue (B) discharge cells are arranged on the same line, the red (R), green (G) and blue (B) discharge cells may be arranged in a different pattern. For instance, a delta type arrangement in which the red (R), green (G), and blue (B) discharge cells are arranged in a triangle shape may be applicable. Further, the discharge cells may have a variety of polygonal shapes such as pentagonal and hexagonal shapes as well as a rectangular shape.

While FIG. 1A has illustrated and described the case where the barrier rib 112 is formed on the rear substrate 111, the barrier rib 112 may be formed on at least one of the front substrate 101 or the rear substrate 111.

In FIG. 1A, the upper dielectric layer 104 and the lower dielectric layer 115 each have a single-layered structure. However, at least one of the upper dielectric layer 104 or the lower dielectric layer 115 may have a multi-layered structure.

While the address electrode 113 positioned on the rear substrate 111 may have a substantially constant width or thickness, a width or thickness of the address electrode 113 inside the discharge cell may be different from a width or thickness of the address electrode 113 outside the discharge cell. For instance, a width or thickness of the address electrode 113 inside the discharge cell may be larger than a width or thickness of the address electrode 113 outside the discharge cell.

FIG. 1B illustrates another structure of the scan electrode 102 and the sustain electrode 103.

The scan electrode 102 and the sustain electrode 103 may have a multi-layered structure, respectively. For instance, the scan electrode 102 and the sustain electrode 103 each include transparent electrodes 102*a* and 103*a* and bus electrodes 102*b* and 103*b*.

The bus electrodes 102*b* and 103*b* may include a substantially opaque material, for instance, at least one of silver (Ag), gold (Au), or aluminum (Al). The transparent electrodes 102*a* and 103*a* may include a substantially transparent material, for instance, indium-tin-oxide (ITO).

Black layers 120 and 130 are formed between the transparent electrodes 102*a* and 103*a* and the bus electrodes 102*b* and 103*b* to prevent the reflection of external light caused by the bus electrodes 102*b* and 103*b*.

The transparent electrodes 102*a* and 103*a* may be omitted from the scan electrode 102 and the sustain electrode 103. In other words, the scan electrode 102 and the sustain electrode 103 may be called an ITO-less electrode in which the transparent electrodes 102*a* and 103*a* are omitted.

Figure 2:
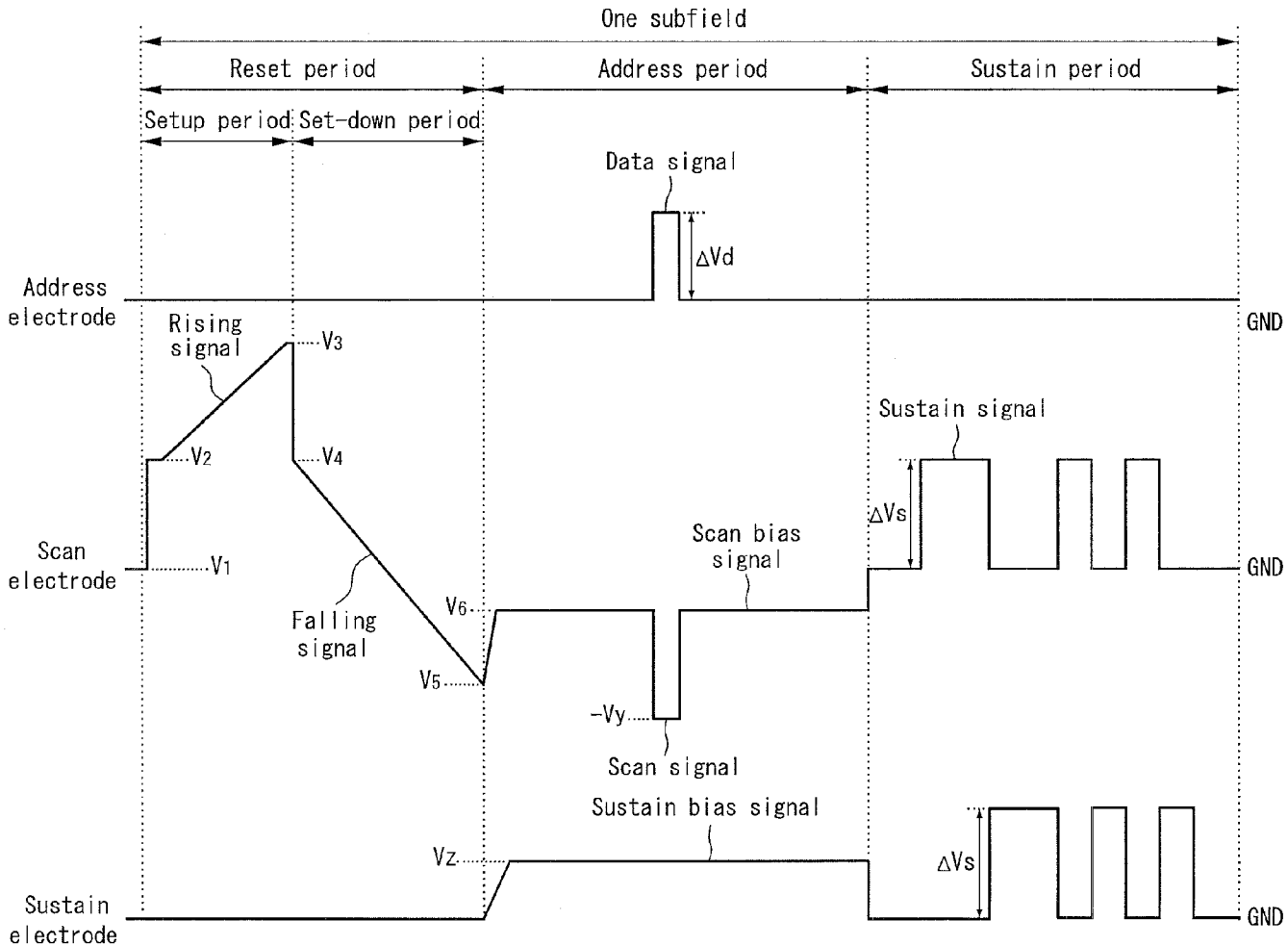
FIG. 2 illustrates an operation of the plasma display panel according to the exemplary embodiment.

FIG. 2 illustrates an operation of the plasma display panel according to the exemplary embodiment. The exemplary embodiment is not limited to FIG. 2, and an operation method of the plasma display can be variously changed.

As illustrated in FIG. 2, during a reset period for initialization of wall charges, a reset signal is supplied to the scan electrode. The reset signal includes a rising signal and a falling signal. The reset period is further divided into a setup period and a set-down period.

During the setup period, the rising signal with a gradually rising voltage is supplied to the scan electrode. The rising signal generates a weak dark discharge (i.e., a setup discharge) inside the discharge cell during the setup period, thereby accumulating a proper amount of wall charges inside the discharge cell.

During the set-down period, a falling signal of a polarity direction opposite a polarity direction of the rising signal is supplied to the scan electrode. The falling signal generates a weak erase discharge (i.e., a set-down discharge) inside the discharge cell. Furthermore, the remaining wall charges are uniform inside the discharge cells to the extent that an address discharge can be stably performed.

During an address period following the reset period, a scan bias signal, which is maintained at a sixth voltage V6 higher than a lowest voltage of the falling signal, is supplied to the scan electrode.

A scan signal falling from the scan bias signal is supplied to the scan electrode.

A width of a scan signal supplied during an address period of at least one subfield may be different from a width of a scan signal supplied during address periods of the other subfields. For instance, a width of a scan signal in a subfield may be larger than a width of a scan signal in the next subfield in time order. Further, a width of the scan signal may be gradually reduced in the order of 2.6 μs, 2.3 μs, 2.1 μs, 1.9 μs, etc., or in the order of 2.6 μs, 2.3 μs, 2.3 μs, 2.1 μs, . . . , 1.9 μs, 1.9 μs, etc.

As above, when the scan signal is supplied to the scan electrode, a data signal corresponding to the scan signal is supplied to the address electrode.

As the voltage difference between the scan signal and the data signal is added to the wall voltage generated during the reset period, the address discharge occurs within the discharge cell to which the data signal is supplied.

A sustain bias signal is supplied to the sustain electrode during the address period to prevent the generation of the unstable address discharge by interference of the sustain electrode Z.

The sustain bias signal is substantially maintained at a sustain bias voltage Vz. The sustain bias voltage Vz is lower than a voltage Vs of a sustain signal and is higher than the ground level voltage GND.

During a sustain period following the address period, a sustain signal is alternately supplied to the scan electrode and the sustain electrode.

As the wall voltage within the discharge cell selected by performing the address discharge is added to the sustain voltage Vs of the sustain signal, every time the sustain signal is supplied, the sustain discharge, i.e., a display discharge occurs between the scan electrode and the sustain electrode.

A plurality of sustain signals are supplied during a sustain period of at least one subfield, and a width of at least one of the plurality of sustain signals may be different from widths of the other sustain signals. For instance, a width of a first supplied sustain signal among the plurality of sustain signals may be larger than widths of the other sustain signals. Hence, a sustain discharge can be more stable.

Figures 3, 4A:
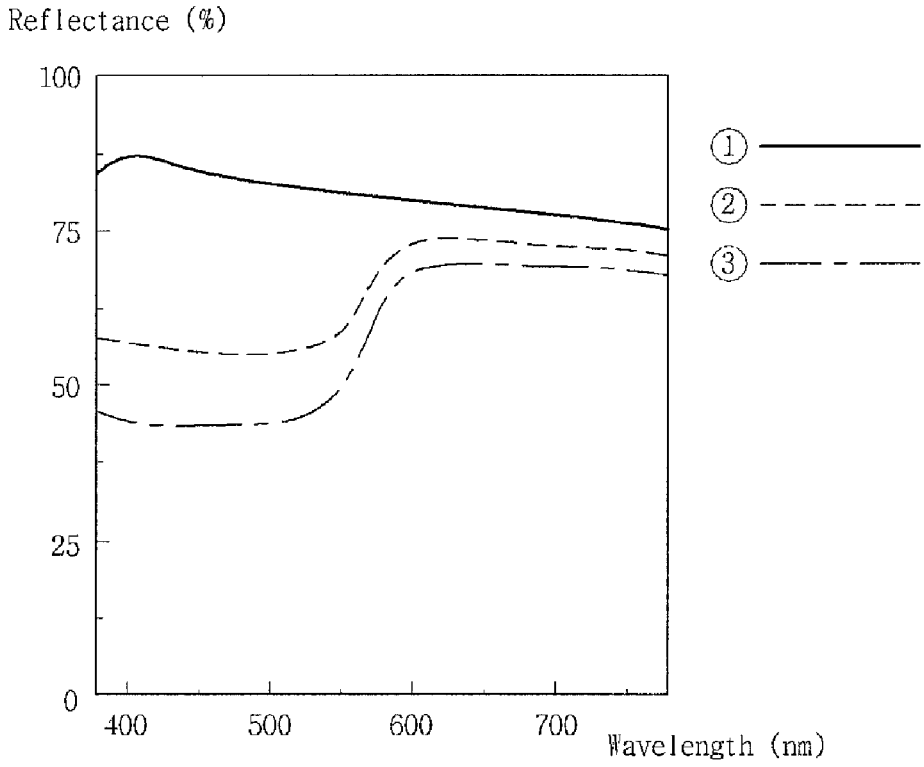
FIG. 3 illustrates a composition of a phosphor layer.
FIGS. 4A and 4B are graphs showing reflectances depending on a composition of each of first and second phosphor layers, respectively.

FIG. 3 illustrates a composition of a phosphor layer.

As illustrated in FIG. 3, a first phosphor layer emitting red light includes a first phosphor material having a white-based color, a red pigment, and an oxide material.

The first phosphor material is not particularly limited except the red light emission. The first phosphor material may be (Y, Gd)BO:Eu in consideration of an emitting efficiency of red light.

The red pigment has a red-based color. The first phosphor layer may have a red-based color by mixing the red pigment with the first phosphor material. The red pigment is not particularly limited except the red-based color. The red pigment may include an iron (Fe)-based material in consideration of facility of powder manufacture, color, and manufacturing cost.

The Fe-based material may be a state of iron oxide ($Fe_2O_3$) in the first phosphor layer. For instance, the Fe-based material may be a state of $\alpha Fe_2O_3$ in the first phosphor layer.

The red pigment may include CdSe, CdS, and the like, in addition to the Fe-based material.

The oxide material can improve a discharge response characteristic between the scan electrode and the address electrode or between the sustain electrode and the address electrode.

The oxide material is not particularly limited except the improvement of the discharge response characteristic between the scan electrode and the address electrode or between the sustain electrode and the address electrode. For instance, the oxide material may include at least one of MgO material, ZnO material, $SiO_2$ material, $TiO_2$ material, $Y_2O_3$ material, $Al_2O_3$ material, $La_2O_3$ material, $Fe_2O_3$ material, EuO material, or CoO material. The oxide material may be the MgO material.

A second phosphor layer emitting blue light includes a second phosphor material having a white-based color, a blue pigment, and an oxide material.

The second phosphor material is not particularly limited except the blue light emission. The second phosphor material may be (Ba, Sr, Eu)$MgAl_{10}O_{17}$ in consideration of an emitting efficiency of blue light.

The blue pigment has a blue-based color. The second phosphor layer may have a blue-based color by mixing the blue pigment with the second phosphor material. The blue pigment is not particularly limited except the blue-based color. The blue pigment may include at least one of a cobalt (Co)-based material, a copper (Cu)-based material, a chrome (Cr)-based material, a nickel (Ni)-based material, an aluminum (Al)-based material, a titanium (Ti)-based material or a neodymium (Nd)-based material, in consideration of facility of powder manufacture, color, and manufacturing cost.

At least one of the Co-based material, the Cu-based material, the Cr-based material, the Ni-based material, the Al-based material, the Ti-based material or the Nd-based material may be a state of metal oxide in the second phosphor layer. For instance, the Co-based material may be a state of $CoAl_2O_4$ in the second phosphor layer.

A third phosphor layer emitting green light includes a third phosphor material having a white-based color, and may not include a pigment.

The third phosphor material is not particularly limited except the green light emission. The third phosphor material may include $Zn_2Si0_4:Mn^{+2}$ and $YBO_3:Tb^{+3}$ in consideration of an emitting efficiency of green light.

FIG. 4A is a graph showing a reflectance of a test model depending on a wavelength.

First, a 7-inch test model on which a first phosphor layer emitting red light from all discharge cells is positioned is manufactured. Then, light is directly irradiated on a barrier rib and the first phosphor layer of the test model in a state where a front substrate of the test model is removed to measure a reflectance of the test model.

The first phosphor layer includes a first phosphor material and a red pigment. The first phosphor material is (Y, Gd)BO:Eu. The red pigment is an Fe-based material, and the Fe-based material in a state of $\alpha Fe_2O_3$ is mixed with the first phosphor material.

In FIG. 4A, ① indicates a case where the first phosphor layer does not include the red pigment. ② indicates a case where the first phosphor layer includes the red pigment of 0.1 part by weight. ③ indicates a case where the first phosphor layer includes the red pigment of 0.5 part by weight.

In case of ① not including the red pigment, a reflectance is equal to or more than about 75% at a wavelength of 400 nm to 750 nm. Because the first phosphor material having a white-based color reflects most of incident light, the reflectance in ① is high.

In case of ② including the red pigment of 0.1 part by weight, a reflectance is equal to or less than about 60% at a wavelength of 400 nm to 550 nm and ranges from about 60% to 75% at a wavelength more than 550 nm.

In case of ③ including the red pigment of 0.5 part by weight, a reflectance is equal to or less than about 50% at a wavelength of 400 nm to 550 nm and ranges from about 50% to 70% at a wavelength more than 550 nm.

Because the red pigment having a red-based color absorbs incident light, the reflectances in ② and ③ are less than the reflectance in ①.

Figures 4B, 5A:
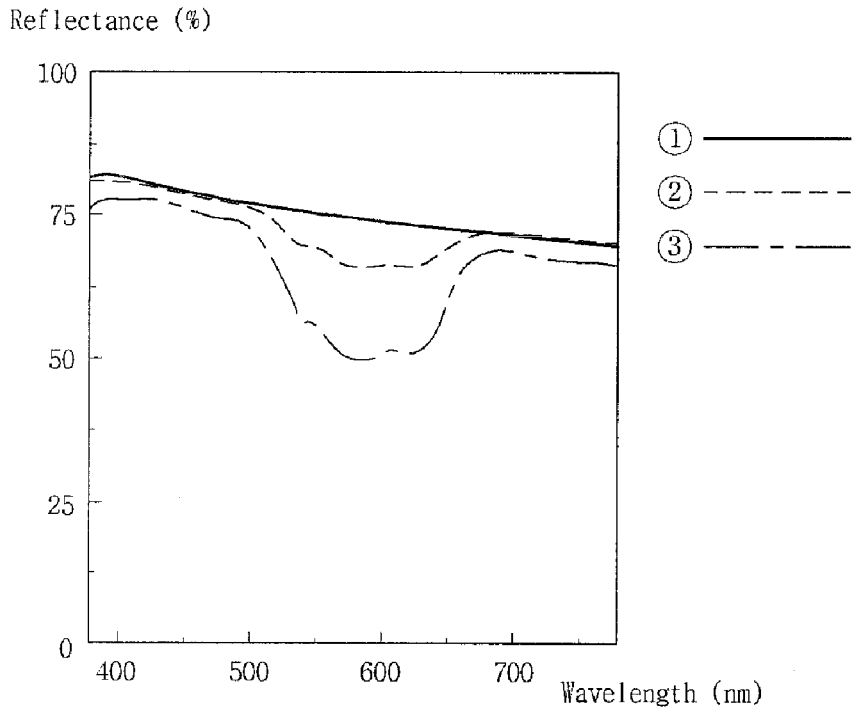
FIGS. 5A and 5B are diagrams for explaining a reason why a phosphor layer includes an oxide material.

FIG. 4B is a graph showing a reflectance of a test module depending on a wavelength. First, a 7-inch test model on which a second phosphor layer emitting blue light from all discharge cells is positioned is manufactured. Then, light is directly irradiated on a barrier rib and the second phosphor layer of the test model in a state where a front substrate of the test model is removed to measure a reflectance of the test model.

The second phosphor layer includes a second phosphor material and a blue pigment. The second phosphor material is (Ba, Sr, Eu)$MgAl_{10}O_{17}$. The blue pigment is a Co-based material, and the Co-based material in a state of $CoAl_2O_4$ is mixed with the second phosphor material.

In FIG. 4B, ① indicates a case where the second phosphor layer does not include the blue pigment. ② indicates a case where the second phosphor layer includes the blue pigment of 0.1 part by weight. ③ indicates a case where the second phosphor layer includes the blue pigment of 1.0 part by weight.

In case of ① not including the blue pigment, a reflectance is equal to or more than about 72% at a wavelength of 400 nm to 750 nm. Because the second phosphor material having a white-based color reflects most of incident light, the reflectance in ① is high.

In case of ② including the blue pigment of 0.1 part by weight, a reflectance is equal to or more than about 74% at a wavelength of 400 nm to 510 nm, falls to about 60% at a wavelength of 510 nm to 650 nm, and rises to about 72% at a wavelength more than 650 nm.

In case of ③ including the blue pigment of 1.0 part by weight, a reflectance is at least 50% at a wavelength of 510 nm to 650 nm.

Because the blue pigment having a blue-based color absorbs incident light, the reflectances in ② and ③ are less than the reflectance in ①. A reduction in the reflectance can improve the contrast characteristic, and thus the image quality can be improved.

While the pigment mixed with the phosphor layer can reduce the panel reflectance, a discharge characteristic may be nonuniform.

For instance, when a scan signal is supplied to the scan electrode and a data signal is supplied to the address electrode, wall charges are accumulated on the surface of particles of the phosphor material. Wall charges may be concentratedly accumulated on a specific portion of the phosphor layer due to a nonuniform height of the phosphor layer, thereby generating a relatively strong discharge in the specific portion.

Since the accumulation amount of wall charges may vary depending on each discharge cell, a discharge may be nonuniform and unstable.

Furthermore, when the phosphor layer includes a pigment (for instance, when the first phosphor layer includes a red pigment with a Fe-based material), wall charges may be more unstably distributed due to the red pigment and a discharge may occur more unstably. As a result, a viewer may watch a noise and the image quality may worsen.

On the contrary, when the phosphor layer includes an oxide material such as an MgO in addition to the pigment, the oxide material acts as a catalyst of a discharge. Hence, a discharge can stably occur between the scan electrode and the address electrode at a relatively low voltage. Before a strong discharge occur at a relatively high voltage in a specific portion of the phosphor layer where wall charges are concentratedly accumulated, a discharge can first occur at a relatively low voltage in a portion of the phosphor layer where the oxide material is positioned. Hence, a discharge characteristic of each discharge cell can be uniform because a secondary electron emission coefficient of the oxide material is high.

Figure 5B:
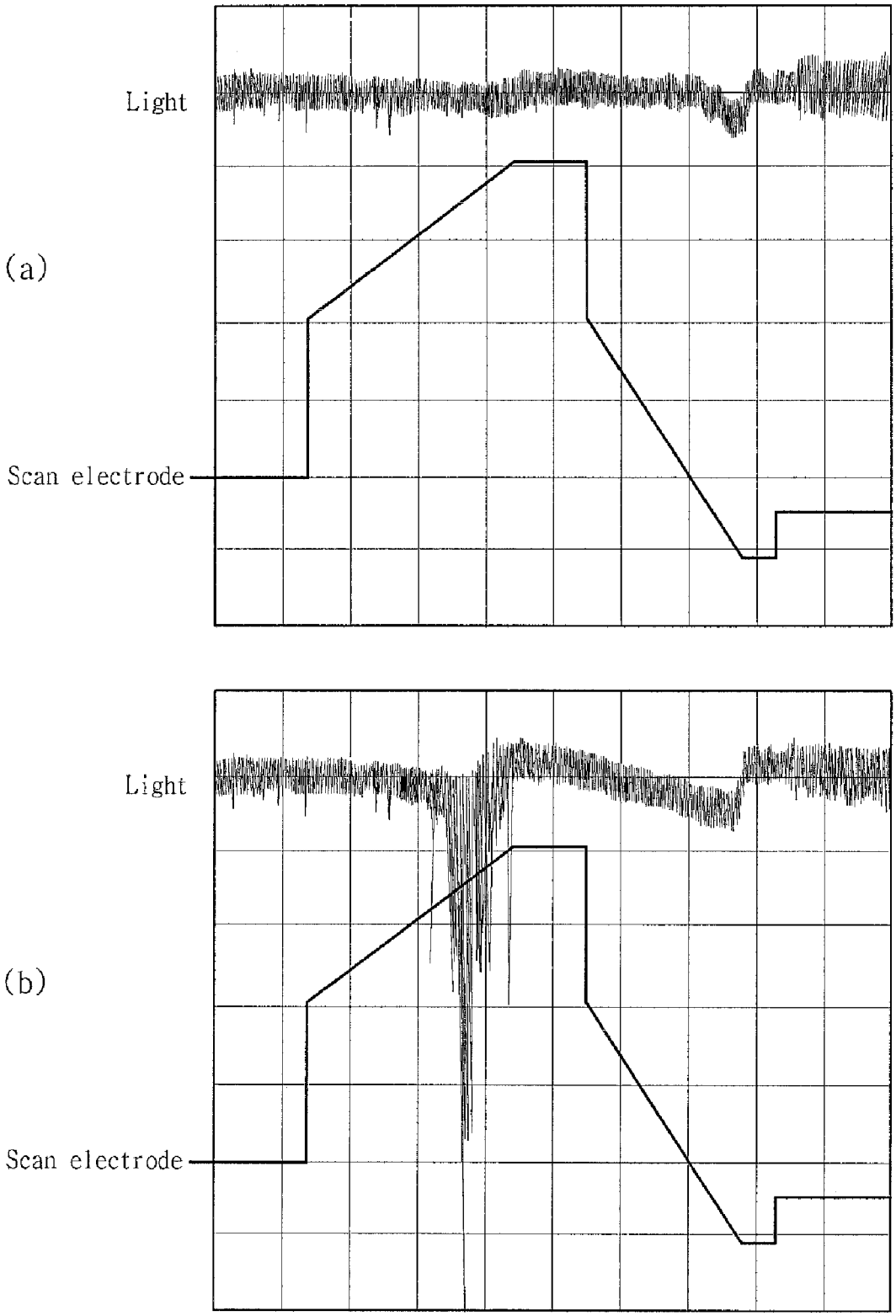

FIGS. 5A and 5B are diagrams for explaining a reason why a phosphor layer includes an oxide material.

FIG. 5A is a table showing a firing voltage, a luminance and a bright room contrast ratio (CR) of each of a comparative example and experimental examples 1, 2 and 3. The bright room contrast ratio measures a contrast ratio in a state where an image with a window pattern corresponding to 25% of the screen size is displayed in a bright room. The firing voltage is a firing voltage measured between the scan electrode and the address electrode.

In the comparative example, a first phosphor layer includes a red pigment of 0.2 part by weight, a second phosphor layer includes a blue pigment of 1.0 part by weight, and the first, second and third phosphor layers do not include an oxide material.

In the experimental example 1, a first phosphor layer includes a red pigment of 0.2 part by weight, a second phosphor layer includes a blue pigment of 1.0 part by weight, and the first, second and third phosphor layers each include MgO material of 0.05 part by weight.

In the experimental example 2, a first phosphor layer includes a red pigment of 0.2 part by weight, a second phosphor layer includes a blue pigment of 1.0 part by weight, and the first, second and third phosphor layers each include MgO material of 0.07 part by weight.

In the experimental example 3, a first phosphor layer includes a red pigment of 0.2 part by weight, a second phosphor layer includes a blue pigment of 1.0 part by weight, and the first, second and third phosphor layers each include MgO material of 0.1 part by weight.

In the comparative example, the firing voltage is 135V, and the luminance is 170 cd/$m^2$.

In the experimental examples 1, 2 and 3, the firing voltage is 127V to 129V lower than the firing voltage of the comparative example, and the luminance is 176 cd/$m^2$ to 178 cd/$m^2$ higher than the luminance of the comparative example. Because the MgO material included in the experimental examples 1, 2 and 3 acted as a catalyst of a discharge, the firing voltage between the scan electrode and the address electrode is lowered. Furthermore, because an intensity of a discharge generated at the same voltage as the comparative example increased due to a fall in the firing voltage, the luminance increased.

While the bright room contrast ratio of the comparative example is 55:1, the bright room contrast ratio of the experimental examples 1, 2 and 3 is 58:1 to 61:1. As could be seen from FIG. 5A, a contrast characteristic of the experimental examples 1, 2 and 3 is larger than that of the comparative example.

The experimental examples 1, 2 and 3 generated a uniform discharge at a lower firing voltage than the comparative example because the quantity of light during a reset period is relatively small in the experimental examples 1, 2 and 3.

In FIG. 5B, (a) is a graph showing the quantity of light in the experimental examples 1, 2 and 3, and (b) is a graph showing the quantity of light in the comparative example.

As illustrated in (b) of FIG. 5B, because a discharge occurred at a relatively high voltage in the comparative example not including the MgO material and an instantaneously strong discharge occurred, the quantity of light instantaneously increased. Hence, the contrast characteristics may worsen.

As illustrated in (a) of FIG. 5B, because a discharge occurred at a relatively low voltage in the experimental examples 1, 2 and 3 including the MgO material, a weak reset discharge constantly occurred during a reset period. Hence, a small quantity of light is generated, and the contrast characteristics could be improved.

The MgO material included in the phosphor layer may be (111), (222), (444), (100), (200) and (400)-oriented MgO materials.

(111), (222) and (444)-oriented MgO materials having a relatively high secondary electron emission coefficient may be used so as to reduce discharge delay time by improving a discharge characteristic between the scan electrode and the address electrode.

(100), (200) and (400)-oriented MgO materials having an excellent sputter-resistance characteristic may be used so as to suppress a degradation of the phosphor layer.

(111), (222) and (444)-oriented MgO materials and (100) (200) and (400)-oriented MgO materials may be used together so as to suppress a degradation of the phosphor layer and to reduce discharge delay time.

FIG. 6 illustrates the particle size of an oxide material.

In FIG. 6, R1 denotes the particle size of an oxide material, and R2 denotes the particle size of the first, second or third phosphor material.

FIG. 6 is a table showing a luminance and a difficulty level in process depending on changes in the particle size of MgO material on condition that the first phosphor material having the substantially equal particle size is used and a content of MgO material used as the oxide material is substantially equal. In FIG. 6, ◎ indicates a reading of "excellent", ○ indicates a reading of "good", and X indicates a reading of "bad".

As illustrated in FIG. 6, when a ratio R1/R2 of the particle size R1 of the MgO material to the particle size R2 of the first phosphor material ranges from 0.001 to 0.25 (i.e., when the particle size R1 of the MgO material is sufficiently smaller than the particle size R2 of the first phosphor material), it is easy to position the MgO particles between the phosphor particles. Hence, an emission path of visible light of the phosphor particles can be sufficiently secured. Accordingly, a luminance is marked with ◎ indicating the reading of "excellent".

When the ratio R1/R2 ranges from 0.275 to 1.0, a luminance is marked with ○ indicating the reading of "good".

On the other hand, when the ratio R1/R2 is equal to or more than 1.0 (i.e., the particle size R1 of the MgO material is larger than the particle size R2 of the first phosphor material), the MgO particles intercept an emission path of visible light of the phosphor particles. Accordingly, a luminance is bad.

When the ratio R1/R2 ranges from 0.001 to 0.003, the difficulty level in a particle treatment process of the MgO material is high and marked with X. Further, because the particle size R1 of the MgO material is excessively smaller than the particle size R2 of the first phosphor material, the MgO particles cannot be positioned on the surface of the phosphor layer and are mostly positioned inside the phosphor layer. Accordingly, the discharge between the scan electrode and the address electrode or between the sustain electrode and the address electrode is not generated stably.

On the other hand, when the ratio R1/R2 ranges from 0.005 to 0.03 and from 0.4 to 1.0, the difficulty level in process is proper.

Further, when the ratio R1/R2 ranges from 0.05 to 0.3, the particle size R1 of the MgO material is optimized such that the difficulty level in process is low. In this case, most of the MgO particles are positioned between the phosphor particles on the surface of the phosphor layer such that the discharge between the scan electrode and the address electrode or between the sustain electrode and the address electrode is generated stably.

As can be seen from FIG. 6, the ratio R1/R2 may range from 0.005 to 1.0. Further, the ratio R1/R2 may range from 0.05 to 0.25. For instance, the particle size of MgO material may range from 20 nm to 3,000 nm.

In FIG. 6, the particle size R1 of the MgO material is smaller than the particle size R2 of the first, second or third phosphor material. However, the particle size R1 of the MgO material may be larger than the particle size R2 of the first, second or third phosphor material.

The MgO particle may have one orientation or two or more different orientation. For instance, only (200)-oriented MgO material may be used, or (200), (220), and (111)-oriented MgO material may be used.

The orientation of the MgO particles may vary depending on various conditions such as a property of the discharge gas, a kind of phosphor material, a voltage magnitude of the driving signal.

Figure 7A:
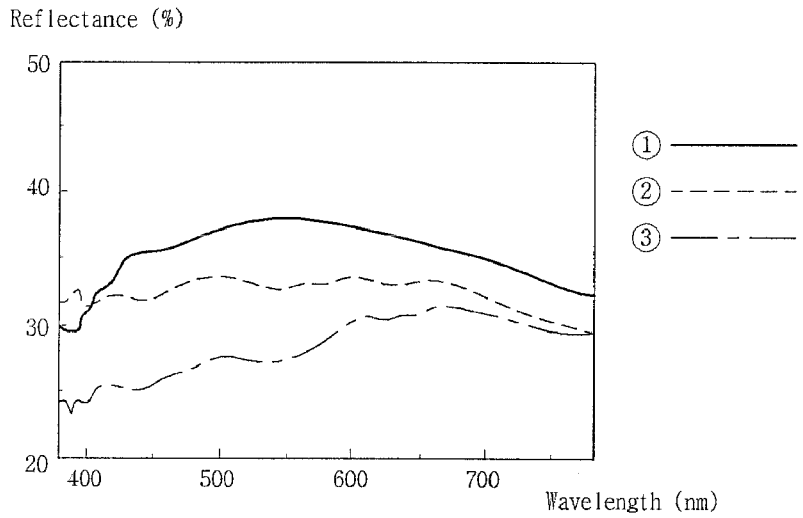
FIGS. 7A and 7B are graphs showing a reflectance and a luminance of the plasma display panel depending on changes in a content of red pigment, respectively.
Figure 7B:
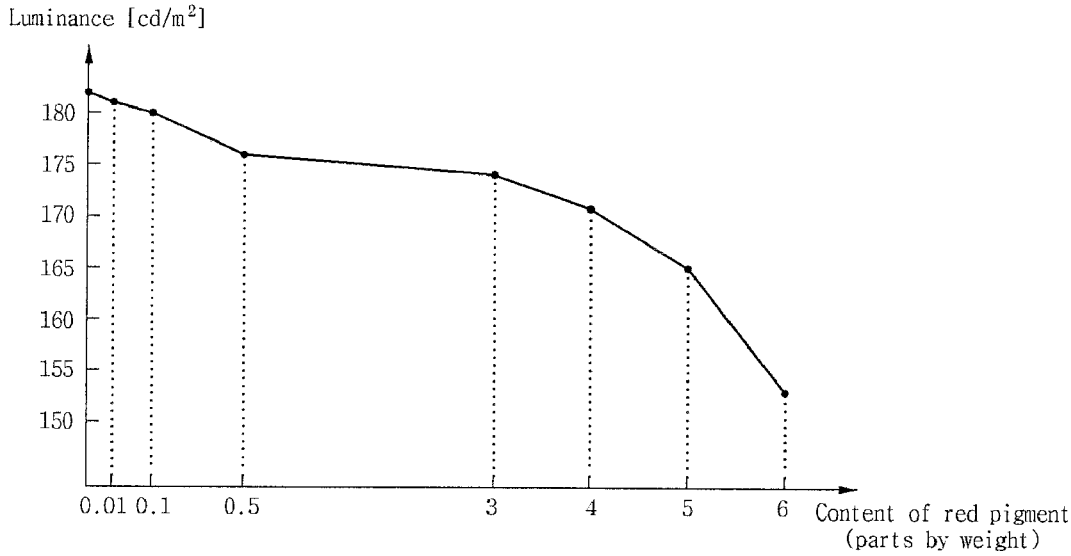

FIGS. 7A and 7B are graphs showing a reflectance and a luminance of the plasma display panel depending on changes in a content of red pigment, respectively.

In FIGS. 7A and 7B, the first phosphor layer is positioned inside the red discharge cell, the second phosphor layer is positioned inside the blue discharge cell, and the third phosphor layer is positioned inside the green discharge cell. Further, a reflectance and a luminance of the plasma display panel are measured depending on changes in a content of red pigment mixed with the first phosphor layer in a state where the blue pigment of 1.0 part by weight is mixed with the second phosphor layer. In this case, a reflectance and a luminance of the plasma display panel are measured in a panel state in which the front substrate and the rear substrate coalesce with each other.

The first phosphor material is (Y, Gd)BO:Eu. The red pigment is an Fe-based material, and the Fe-based material in a state of $\alpha Fe_2O_3$ is mixed with the first phosphor material.

The second phosphor material is (Ba, Sr, Eu)$MgAl_{10}O_{17}$. The blue pigment is a Co-based material, and the Co-based material in a state of $CoAl_2O_4$ is mixed with the second phosphor material.

The first, second and third phosphor layers include the MgO material of 0.2 part by weight.

In FIG. 7A, ① indicates a case where the first phosphor layer does not include the red pigment in a state where the second phosphor layer includes the blue pigment of 1.0 part by weight. ② indicates a case where the first phosphor layer includes the red pigment of 0.1 part by weight in a state where the second phosphor layer includes the blue pigment of 1.0 part by weight. ③ indicates a case where the first phosphor layer includes the red pigment of 0.5 part by weight in a state where the second phosphor layer includes the blue pigment of 1.0 part by weight.

In case of ① not including the red pigment, a panel reflectance rises from about 33% to 38% at a wavelength of 400 nm to 550 nm. A panel reflectance falls to about 33% at a wavelength more than 550 nm. In other words, a panel reflectance has a high value of about 37% to 38% at a wavelength of 500 nm to 600 nm.

Because the first phosphor material having a white-based color reflects most of incident light, the panel reflectance in ① is relatively high although the blue pigment is mixed with the second phosphor layer.

In case of ② including the red pigment of 0.1 part by weight, a panel reflectance is equal to or less than about 34% at a wavelength of 400 nm to 750 nm, and has a relatively small value of about 33% to 34% at a wavelength of 500 nm to 600 nm.

In case of ③ including the red pigment of 0.5 part by weight, a panel reflectance ranges from about 24% to 31.5% at a wavelength of 400 nm to 650 nm and falls to about 30% at a wavelength of 650 nm to 750 nm. Further, a panel reflectance has a relatively small value of about 27.5% to 29.5% at a wavelength of 500 nm to 600 nm.

As above, as a content of red pigment increases, the panel reflectance decreases.

There is a relatively great difference between the panel reflectance in ① not including the red pigment and the panel reflectance in ② and ③ including the red pigment at a wavelength of 500 nm to 600 nm, for instance, at a wavelength of 550 nm.

Because a wavelength of 500 nm to 600 nm mainly appears red, orange and yellow in visible light, a high panel reflectance at a wavelength of 500 nm to 600 nm means that a displayed image is close to red. In this case, because a color temperature is relatively low, a viewer may easily feel eyestrain and an image may be not clear.

On the other hand, a low panel reflectance at a wavelength of 500 nm to 600 nm means that absorptance of red, orange and yellow light is high. Hence, a color temperature of a displayed image is relatively high, and thus an image can be clearer.

Accordingly, the relatively great difference between the panel reflectance in ① and the panel reflectance in ② and ③ at a wavelength of 500 nm to 600 nm means that an excessive reduction in the color temperature can be prevented by mixing the red pigment with the first phosphor layer. Hence, the viewer can watch a clearer image.

Considering the description of FIG. 7A, a color temperature of the panel can be improved by setting the panel reflectance to be equal to or less than 30% at a wavelength of 500 nm to 600 nm, for instance, at a wavelength of 550 nm.

FIG. 7B is a graph showing a luminance of the same image depending on changes in a content of red pigment included in the first phosphor layer in a state where a content of blue pigment included in the second phosphor layer is fixed.

As illustrated in FIG. 7B, a luminance of an image displayed when the first phosphor layer does not include the red pigment is about 182 cd/m$^2$.

When a content of red pigment is 0.01 part by weight, a luminance of the image is reduced to about 181 cd/m$^2$. The reason why the red pigment reduces the luminance of the image is that particles of the red pigment cover a portion of the particle surface of the first phosphor material, thereby hindering ultraviolet rays generated by a discharge inside the discharge cell from being irradiated on the particles of the first phosphor material.

When a content of red pigment ranges from 0.1 to 3 parts by weight, a luminance of the image ranges from about 174 cd/m$^2$ to 180 cd/m$^2$.

When a content of red pigment ranges from 3 to 5 parts by weight, a luminance of the image ranges from about 165 cd/m$^2$ to 174 cd/m$^2$.

When a content of red pigment is equal to or more than 6 parts by weight, a luminance of the image is sharply reduced to a value equal to or less than about 153 cd/m$^2$. In other words, when a large amount of red pigment is mixed, the particles of the red pigment cover a large area of the particle surface of the first phosphor material and thus the luminance is sharply reduced.

Considering the description of FIGS. 7A and 7B, a content of red pigment may range from 0.01 to 5 parts by weight so as to prevent a reduction in the luminance while the panel reflectance is reduced. A content of red pigment may range from 0.1 to 3 parts by weight.

Figure 8A:
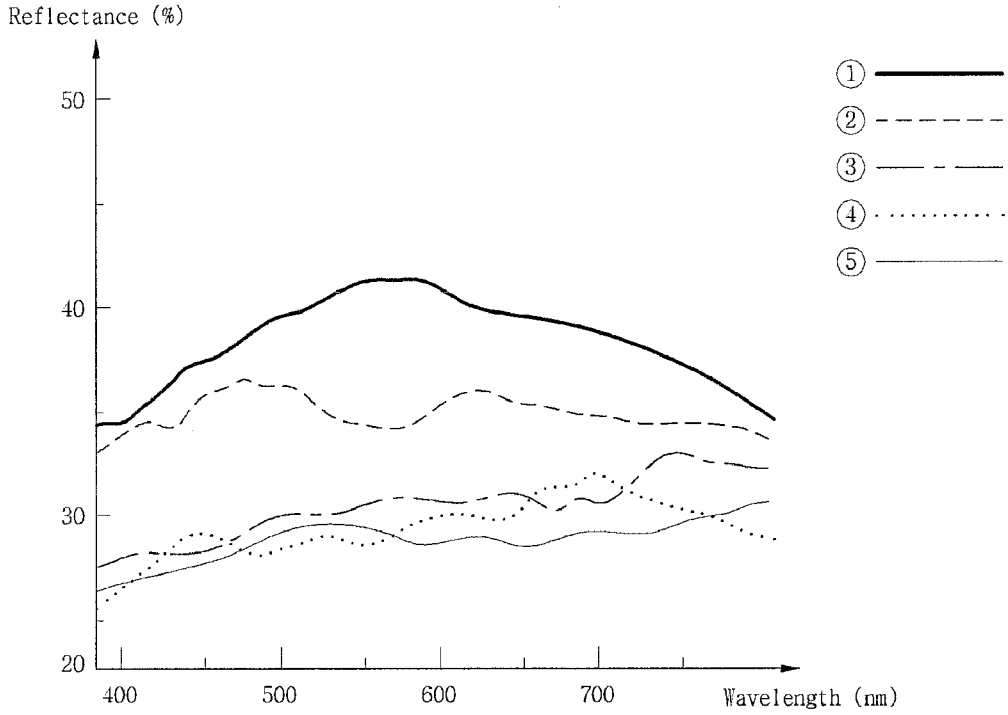
FIGS. 8A and 8B are graphs showing a reflectance and a luminance of a plasma display panel depending on changes in a content of blue pigment, respectively.
Figure 8B:
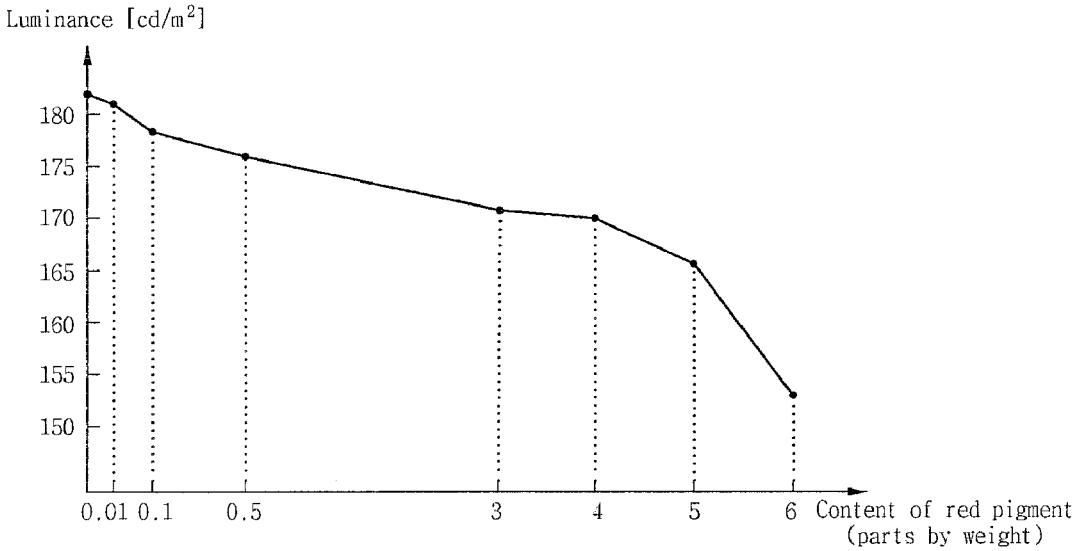

FIGS. 8A and 8B are graphs showing a reflectance and a luminance of a plasma display panel depending on changes in a content of blue pigment, respectively. A description in FIGS. 8A and 8B overlapping the description in FIGS. 7A and 7B is briefly made or entirely omitted.

In FIGS. 8A and 8B, the first phosphor layer is positioned inside the red discharge cell, the second phosphor layer is positioned inside the blue discharge cell, and the third phosphor layer is positioned inside the green discharge cell. Further, a reflectance and a luminance of the plasma display panel are measured depending on changes in a content of blue pigment mixed with the second phosphor layer in a state where the red pigment of 0.2 part by weight is mixed with the first phosphor layer. In this case, a reflectance and a luminance of the plasma display panel are measured in a panel state in which the front substrate and the rear substrate coalesce with each other. The other experimental conditions in FIGS. 8A and 8B are the same as the experimental conditions in FIGS. 7A and 7B.

In FIG. 8A, ① indicates a case where the second phosphor layer does not include the blue pigment in a state where the first phosphor layer includes the red pigment of 0.2 part by weight. ② indicates a case where the second phosphor layer includes the blue pigment of 0.1 part by weight in a state where the first phosphor layer includes the red pigment of 0.2 part by weight. ③ indicates a case where the second phosphor layer includes the blue pigment of 0.5 part by weight in a state where the first phosphor layer includes the red pigment of 0.2 part by weight. ④ indicates a case where the second phosphor layer includes the blue pigment of 3 parts by weight in a state where the first phosphor layer includes the red pigment of 0.2 part by weight. ⑤ indicates a case where the second phosphor layer includes the blue pigment of 7 parts by weight in a state where the first phosphor layer includes the red pigment of 0.2 part by weight.

In case of ① not including the blue pigment, a panel reflectance rises from about 35% to 40.5% at a wavelength of 400 nm to 550 nm. A panel reflectance falls to about 35.5% at a wavelength more than 550 nm. In other words, a panel reflectance has a high value of about 39% to 40.5% at a wavelength of 500 nm to 600 nm.

Because the second phosphor material having a white-based color reflects most of incident light, the panel reflectance in ① is relatively high although the red pigment is mixed with the first phosphor layer.

In case of ② including the blue pigment of 0.1 part by weight, a panel reflectance is equal to or less than about 38% at a wavelength of 400 nm to 750 nm, and has a relatively small value of about 34% to 37% at a wavelength of 500 nm to 600 nm.

In case of ③ including the blue pigment of 0.5 part by weight, a panel reflectance ranges from about 26% to 29% at a wavelength of 400 nm to 650 nm and falls from about 28% to 32.5% at a wavelength of 650 nm to 750 nm. Further, a panel reflectance has a relatively small value of about 28% to 29% at a wavelength of 500 nm to 600 nm.

In case of ④ including the blue pigment of 3 parts by weight, a panel reflectance ranges from about 22.5% to 29% at a wavelength of 400 nm to 650 nm and ranges from about 29% to 31% at a wavelength of 650 nm to 750 nm. Further, a panel reflectance has a relatively small value of about 26.5% to 28% at a wavelength of 500 nm to 600 nm.

In case of ⑤ including the blue pigment of 7 parts by weight, a panel reflectance ranges from about 25% to 28% at a wavelength of 400 nm to 700 nm and ranges from about 28% to 30% at a wavelength more than 700 nm.

FIG. 8B is a graph showing a luminance of the same image depending on changes in a content of blue pigment included in the second phosphor layer in a state where a content of red pigment included in the first phosphor layer is fixed.

As illustrated in FIG. 8B, a luminance of an image displayed when the second phosphor layer does not include the blue pigment is about 182 cd/m$^2$.

When a content of blue pigment is 0.01 part by weight, a luminance of the image is about 181 cd/m$^2$.

When a content of blue pigment is 0.1 part by weight, a luminance of the image is about 178 cd/m$^2$.

When a content of blue pigment ranges from 0.5 to 4 parts by weight, a luminance of the image has a stable value of about 170 cd/m$^2$ to 176 cd/m$^2$.

When a content of blue pigment ranges from 4 to 5 parts by weight, a luminance of the image ranges from about 166 cd/m$^2$ to 170 cd/m$^2$.

When a content of blue pigment exceeds 6 parts by weight, a luminance of the image is sharply reduced to a value equal to or less than about 152 cd/m$^2$. In other words, when a large amount of blue pigment is mixed, particles of the blue pigment cover a large area of the particle surface of the second phosphor material and thus the luminance is sharply reduced.

Considering the description of FIGS. 8A and 8B, a content of second blue pigment may range from 0.01 to 5 parts by weight so as to prevent a reduction in the luminance while the panel reflectance is reduced. A content of blue pigment may range from 0.5 to 4 parts by weight.

Figure 9:
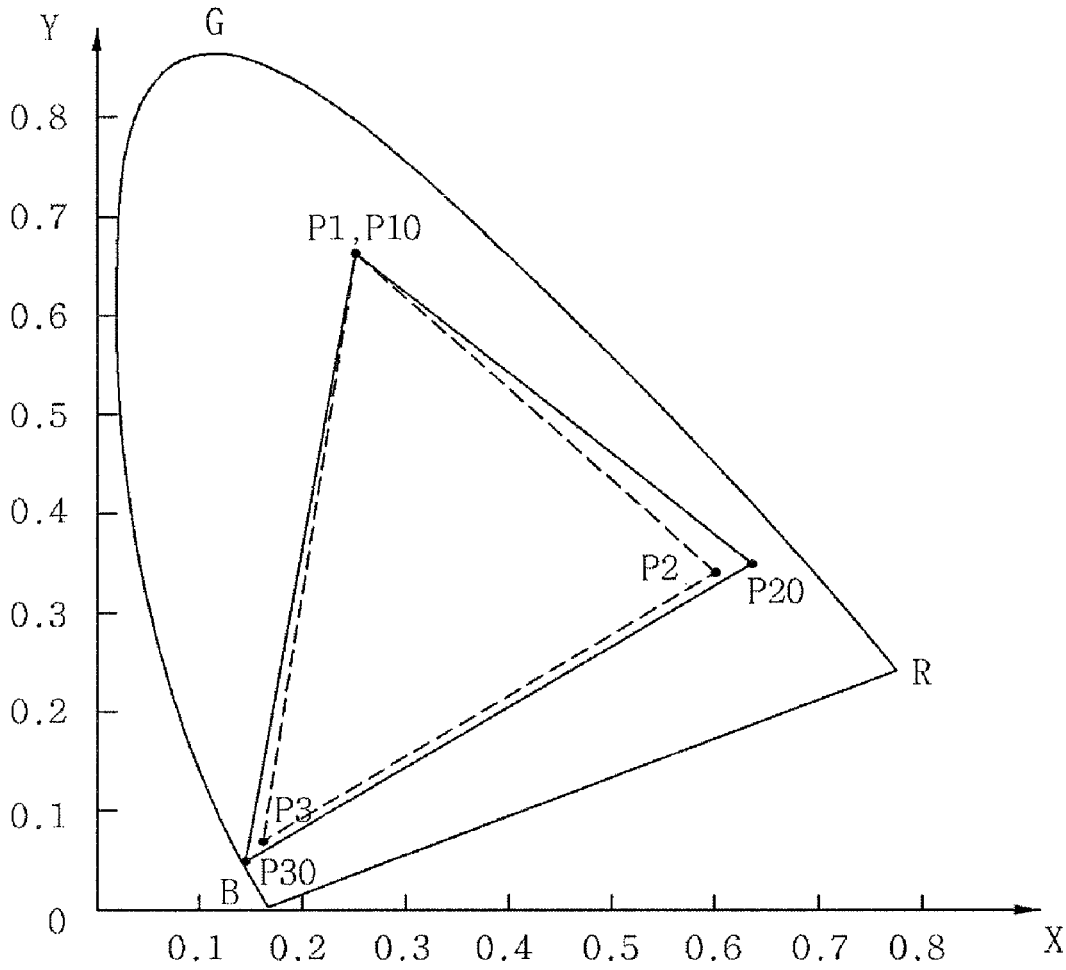
FIG. 9 is a graph showing color coordinates of the plasma display panel according to the exemplary embodiment.

FIG. 9 is a graph showing color coordinates of a 1-typed panel and a 2-typed panel.

A 1-typed panel in which a first phosphor layer includes a red pigment of 0.2 part by weight a second phosphor layer includes a blue pigment of 1.0 part by weight, and a 2-typed panel not including a red pigment and a blue pigment are manufactured. Then, color coordinates are measured using a photodetector (MCPD-1000) in a state where the same driving signal is supplied to the 1-typed and 2-typed panels.

In the 2-typed panel, a green coordinate P1 has X-axis coordinate of about 0.269 and Y-axis coordinate of about 0.668; a red coordinate P2 has X-axis coordinate of about 0.600 and Y-axis coordinate of about 0.335; and a blue coordinate P3 has X-axis coordinate of about 0.160 and Y-axis coordinate of about 0.065.

An area of a triangle formed by connecting the coordinates P1, P2 and P3 of the 2-typed panel is a color representable range of the 2-typed panel.

In the 1-typed panel, a green coordinate P10 has X-axis coordinate of about 0.268 and Y-axis coordinate of about 0.667; a red coordinate P20 has X-axis coordinate of about 0.640 and Y-axis coordinate of about 0.355; and a blue coordinate P30 has X-axis coordinate of about 0.154 and Y-axis coordinate of about 0.060.

An area of a triangle formed by connecting the coordinates P10, P20 and P30 of the 1-typed panel is larger than the area of the triangle formed by connecting the coordinates P1, P2 and P3 of the 2-typed panel. In other words, a color representable range of the 1-typed panel is wider than a color representable range of the 2-typed panel. The reason is that red and blue representable ranges of the 1-typed panel including the red pigment and the blue pigment increase.

When at least one of the green, red or blue coordinates is excessively large or small, the image quality may worsen. For instance, when the red coordinate is excessively large, the entire image may be red. When the red coordinate is excessively small, a red representable range may be excessively reduced.

When the pigment is mixed with the phosphor material, the amount of pigment may be adjusted in consideration of coordinates. For instance, when an excessively large amount of pigment is used, a luminance of a displayed image may be excessively reduced. When an excessively small amount of pigment is used, a panel reflectance may excessively increase.

Considering the color representable range, the reflectance and the luminance, a red coordinate may have X-axis coordinate of 0.620 to 0.650 and Y-axis coordinate of 0.340 to 0.370; a blue coordinate may have X-axis coordinate of 0.135 to 0.165 and Y-axis coordinate of 0.040 to 0.070; and a green coordinate may have X-axis coordinate of 0.265 to 0.295 and Y-axis coordinate of 0.640 to 0.670.

A method of manufacturing the first phosphor layer will be described below as an example of a method of manufacturing the phosphor layer.

First, a powder of the first phosphor material including (Y, Gd)BO:Eu and a powder of the red pigment including $\alpha Fe_2O_3$ are mixed with a binder and a solvent to form a phosphor paste. In this case, the red pigment of a state mixed with gelatin may be mixed with the binder and the solvent. A viscosity of the phosphor paste may range from about 1,500 CP to 30,000 CP. An additive such as surfactant, silica, dispersion stabilizer may be added to the phosphor paste, as occasion demands.

The binder used may be ethyl cellulose-based or acrylic resin-based binder or polymer-based binder such as PMA or PVA. However, the binder is not particularly limited thereto. The solvent used may use α-terpineol, butyl carbitol, diethylene glycol, methyl ether, and so forth. However, the solvent is not particularly limited thereto.

The phosphor paste is coated inside the discharge cells partitioned by the barrier ribs. Then, a drying or firing process is performed on the coated phosphor paste to form the first phosphor layer.

Figures 10A, 10B:
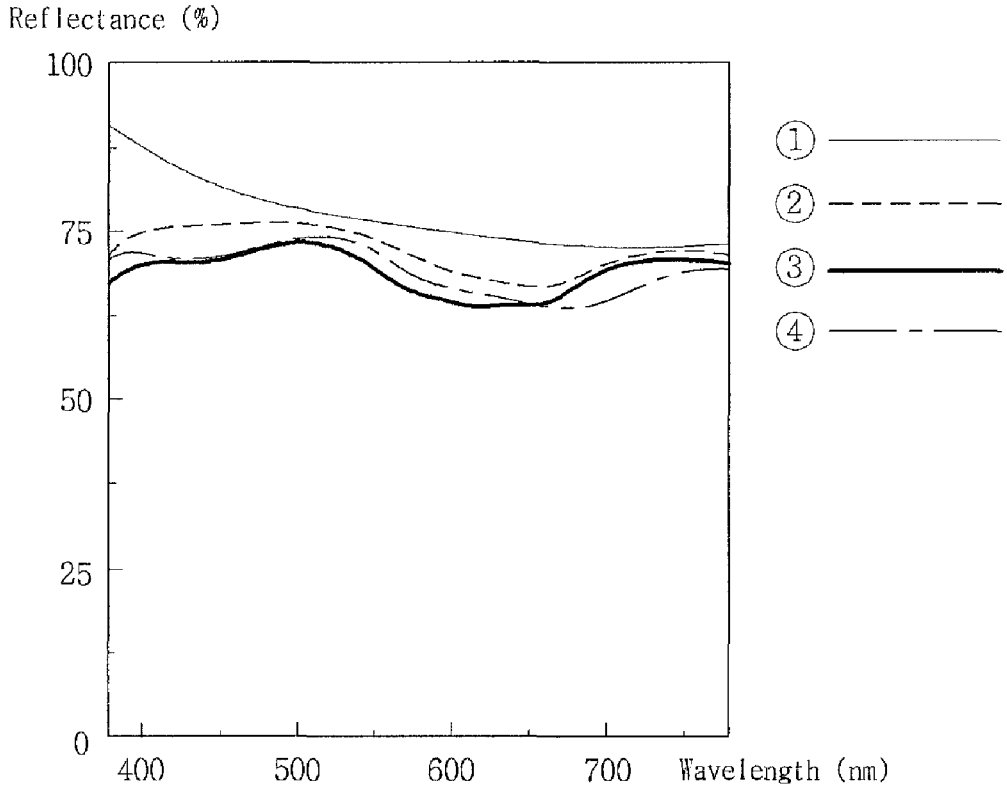
FIGS. 10A and 10B illustrate another implementation of a composition of a phosphor layer.

FIGS. 10A and 10B illustrate another implementation of a composition of a phosphor layer. A description in FIGS. 10A and 10B overlapping the description in FIG. 3 is briefly made or entirely omitted.

As illustrated in FIG. 1A, the third phosphor layer emitting green light include a third phosphor material having a white-based color and a green pigment.

A description in FIG. 10A may be substantially the same as the description in FIG. 3 except that the third phosphor layer includes the green pigment.

The green pigment has a green-based color. The third phosphor layer may a green-based color by mixing the green pigment with the third phosphor material. The green pigment is not particularly limited except the green-based color. The green pigment may include a zinc (Zn) material in consideration of facility of powder manufacture, color, and manufacturing cost.

The Zn-based material may be in a state of zinc oxide, for instance, in a state of $ZnCO_2O_4$ in the third phosphor layer.

FIG. 10B is a graph showing a reflectance of a test model depending on a wavelength.

Similar to FIGS. 4A and 4B, a 7-inch test model on which a third phosphor layer emitting green light from all discharge cells is positioned is manufactured. Then, light is directly irradiated on a barrier rib and the third phosphor layer of the test model in a state where a front substrate of the test model is removed to measure a reflectance of the test model.

The third phosphor layer includes a third phosphor material and a green pigment. The third phosphor material includes $Zn_2Si0_4:Mn^{+2}$ and $YBO_3:Tb^{+3}$ in a ratio of 5:5. The green pigment is a Zn-based material, and the Zn-based material in a state of $ZnCO_2O_4$ is mixed with the third phosphor material.

In FIG. 10B, ① indicates a case where the third phosphor layer does not include the green pigment. ② indicates a case where the third phosphor layer includes the green pigment of 0.1 part by weight. ③ indicates a case where the third phosphor layer includes the green pigment of 0.5 part by weight. ④ indicates a case where the third phosphor layer includes the green pigment of 1.0 part by weight.

In case of ① not including the green pigment, a reflectance is equal to or more than about 75% at a wavelength of 400 nm to 750 nm and is equal to or more than about 80% at a wavelength of 400 nm to 500 nm.

Because the third phosphor material having a white-based color reflects most of incident light, the reflectance in ① is high.

In case of ② including the green pigment of 0.1 part by weight, a reflectance is equal to or less than about 75% at a wavelength of 400 nm to 550 nm and ranges from about 66% to 70% at a wavelength of 550 nm to 700 nm.

In case of ③ including the green pigment of 0.5 part by weight, a reflectance is equal to or less than about 73% at a wavelength of 400 nm to 550 nm and ranges from about 63% to 65% at a wavelength more than 550 nm.

In case of ④ including the green pigment of 1.0 part by weight, a reflectance is similar to the reflectance in ③ at a wavelength of 400 nm to 750 nm.

Because the green pigment having a green-based color absorbs incident light, the reflectances in ②, ③ and ④ are less than the reflectance in ①.

The fact that the reflectances in ③ and ④ are similar to each other means that a reduction width of the panel reflectance is small although a content of green pigment increases.

Figures 11A, 11B:
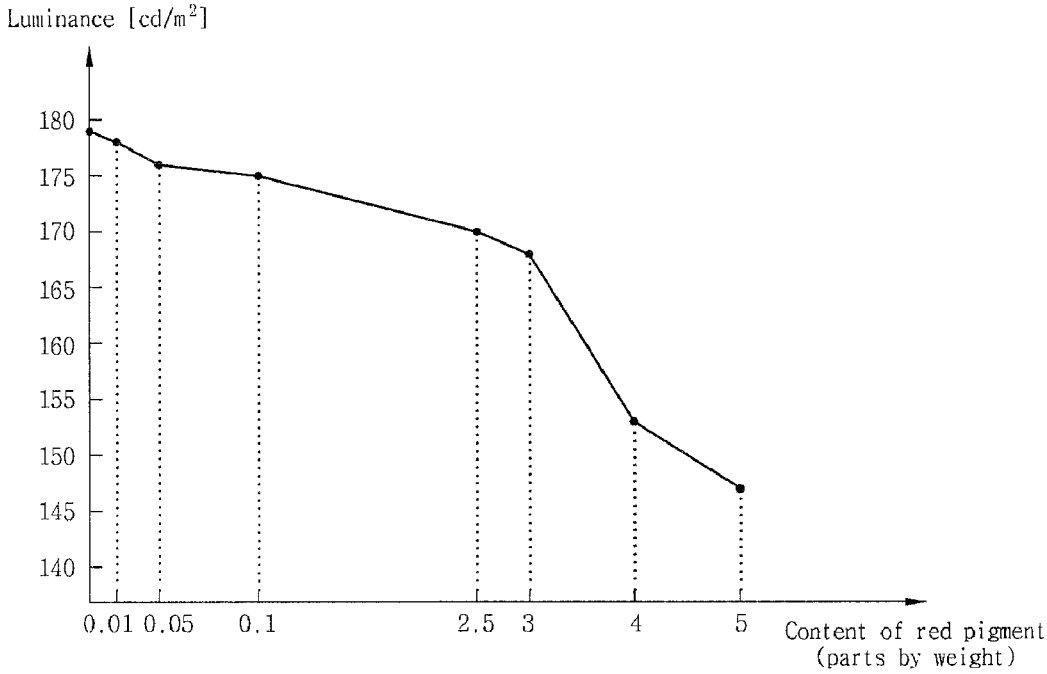
FIGS. 11A and 11B illustrate a reflectance and a luminance of a plasma display panel depending on changes in a content of green pigment, respectively.

FIGS. 11A and 11B illustrate a reflectance and a luminance of a plasma display panel depending on changes in a content of green pigment, respectively.

In FIGS. 11A and 11B, the first phosphor layer is positioned inside the red discharge cell, the second phosphor layer is positioned inside the blue discharge cell, and the third phosphor layer is positioned inside the green discharge cell. Further, a reflectance and a luminance of the plasma display panel are measured depending on changes in a content of green pigment mixed with the third phosphor layer in a state where the blue pigment of 1.0 part by weight is mixed with the second phosphor layer and the red pigment of 0.2 part by weight is mixed with the first phosphor layer. In this case, a reflectance and a luminance of the plasma display panel are measured in a panel state in which the front substrate and the rear substrate coalesce with each other.

The first phosphor material is (Y, Gd)BO:Eu. The red pigment is an Fe-based material, and the Fe-based material in a state of $\alpha Fe_2O_3$ is mixed with the first phosphor material.

The second phosphor material is $(Ba, Sr, Eu)MgAl_{10}O_{17}$. The blue pigment is a Co-based material, and the Co-based material in a state of $CoAl_2O_4$ is mixed with the second phosphor material.

The third phosphor material includes $Zn_2Si0_4:Mn^{+2}$ and $YBO_3:Tb^{+3}$ in a ratio of 5:5. The green pigment is a Zn-based material, and the Zn-based material in a state of $ZnCO_2O_4$ is mixed with the third phosphor material.

FIG. 11A is a table showing a reflectance at a wavelength of 550 nm.

As illustrated in FIG. 11A, when a content of green pigment is 0, a panel reflectance is a relatively high value of 28%.

When a content of green pigment is 0.01 part by weight, a panel reflectance is about 26.5%. When a content of green pigment is 0.05 part by weight, a panel reflectance is about 26.2%.

When a content of green pigment is 0.1 part by weight, a panel reflectance is about 26%. When a content of green pigment is 0.2 part by weight, a panel reflectance is about 25.9%.

When a content of green pigment greatly increases to 2.5 parts by weight, a panel reflectance falls to about 24.3%.

When a content of green pigment is 3 parts by weight, a panel reflectance is about 24%.

When a content of green pigment is 4, 5 and 7 parts by weight, respectively, a panel reflectance is about 23.8%, 23.5% and 22.8%, respectively.

As can be seen from FIG. 11A, when a content of green pigment is equal to or more than 4 parts by weight, a reduction width of the panel reflectance is small.

FIG. 11B is a graph showing a luminance of the same image depending on changes in a content of green pigment included in the third phosphor layer in a state where a content of each of the red pigment and the blue pigment is fixed.

As illustrated in FIG. 11B, a luminance of an image displayed when the third phosphor layer does not include the green pigment is about 179 $cd/m^2$.

When a content of green pigment is 0.01 part by weight, a luminance of the image is reduced to about 178 $cd/m^2$. The reason why the green pigment reduces the luminance of the image is that particles of the green pigment cover a portion of the particle surface of the third phosphor material, thereby hindering ultraviolet rays generated by a discharge inside the discharge cell from being irradiated on the particles of the third phosphor material.

When a content of green pigment ranges from 0.05 to 2.5 parts by weight, a luminance of the image has a stable value of about 170 $cd/m^2$ to 176 $cd/m^2$.

When a content of green pigment is 3 parts by weight, a luminance of the image is about 168 $cd/m^2$.

When a content of green pigment is equal to or more than 4 parts by weight, a luminance of the image is sharply reduced to a value equal to or less than about 153 $cd/m^2$. In other words, when a large amount of green pigment is mixed, the particles of the green pigment cover a large area of the particle surface of the third phosphor material and thus the luminance is sharply reduced.

Considering the description of FIGS. 11A and 11B, a content of green pigment may range from 0.01 to 3 parts by weight so as to prevent a reduction in the luminance while the panel reflectance is reduced. A content of green pigment may range from 0.05 to 2.5 parts by weight.

A reduction width in the panel reflectance when a content of green pigment increases is smaller than a reduction width in the panel reflectance when the red pigment and the blue pigment are mixed. Accordingly, a content of green pigment may be smaller than a content of each of the red pigment and the blue pigment. Further, the green pigment may not be mixed.

Figure 12:
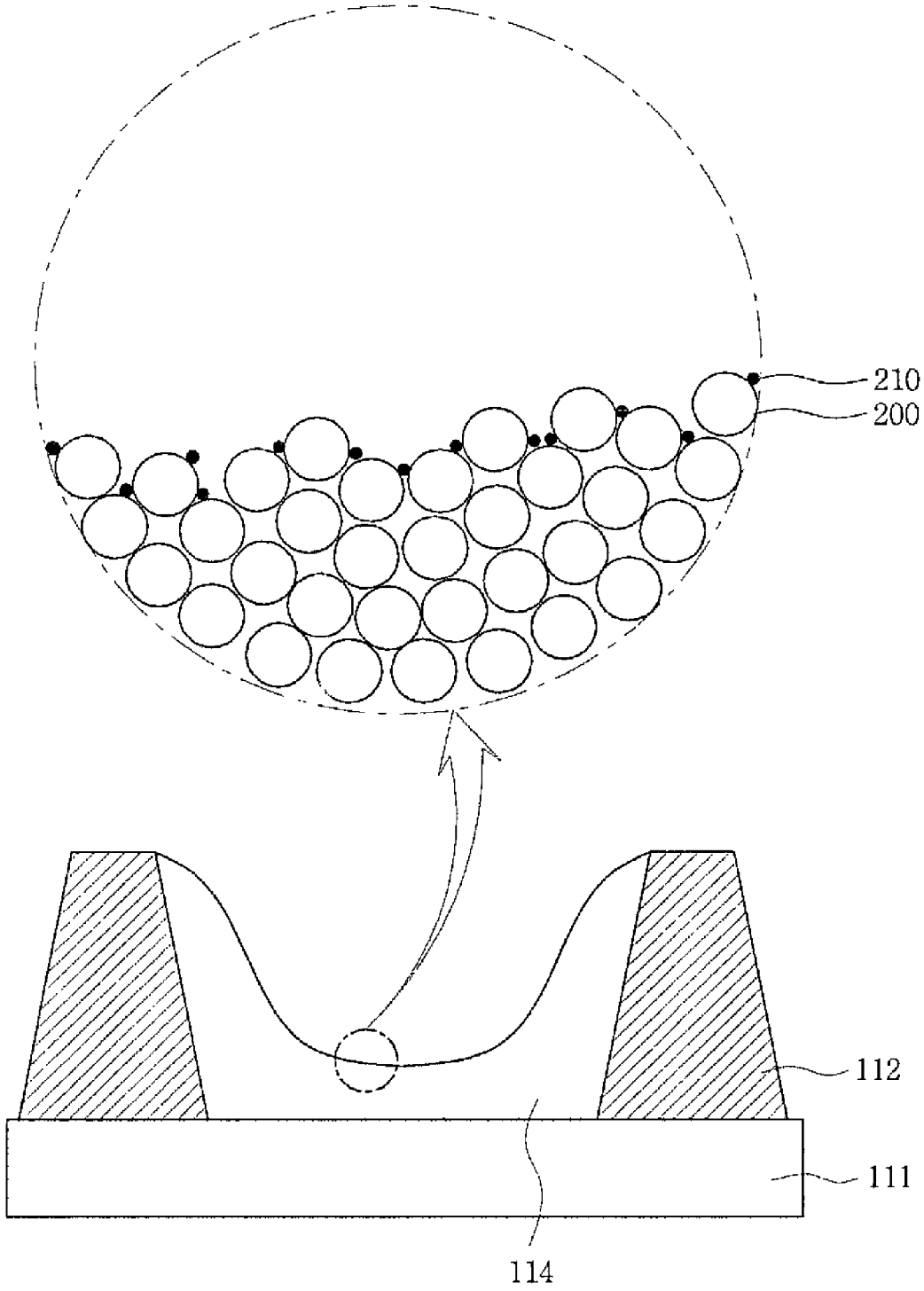
FIG. 12 illustrates an implementation of the distribution of particles of an oxide material of a phosphor layer.

FIG. 12 illustrates an implementation of the distribution of particles of an oxide material of a phosphor layer. Although it is not shown in FIG. 12, a phosphor layer may include a pigment. Only, a description of the pigment is omitted in FIG. 12.

As illustrated in FIG. 12, at least one of particles 200 of a phosphor material may be exposed on the surface of the phosphor layer 114 in a direction of the discharge cell. For instance, since particles 210 of an oxide material are positioned between the particles 200 of the phosphor material on the surface of the phosphor layer 114, at least one phosphor particle 200 may be exposed.

Since the oxide particles 210 are positioned between the phosphor particles 200, a discharge response characteristic between the scan electrode and the address electrode or between the sustain electrode and the address electrode can be improved.

Figure 13:
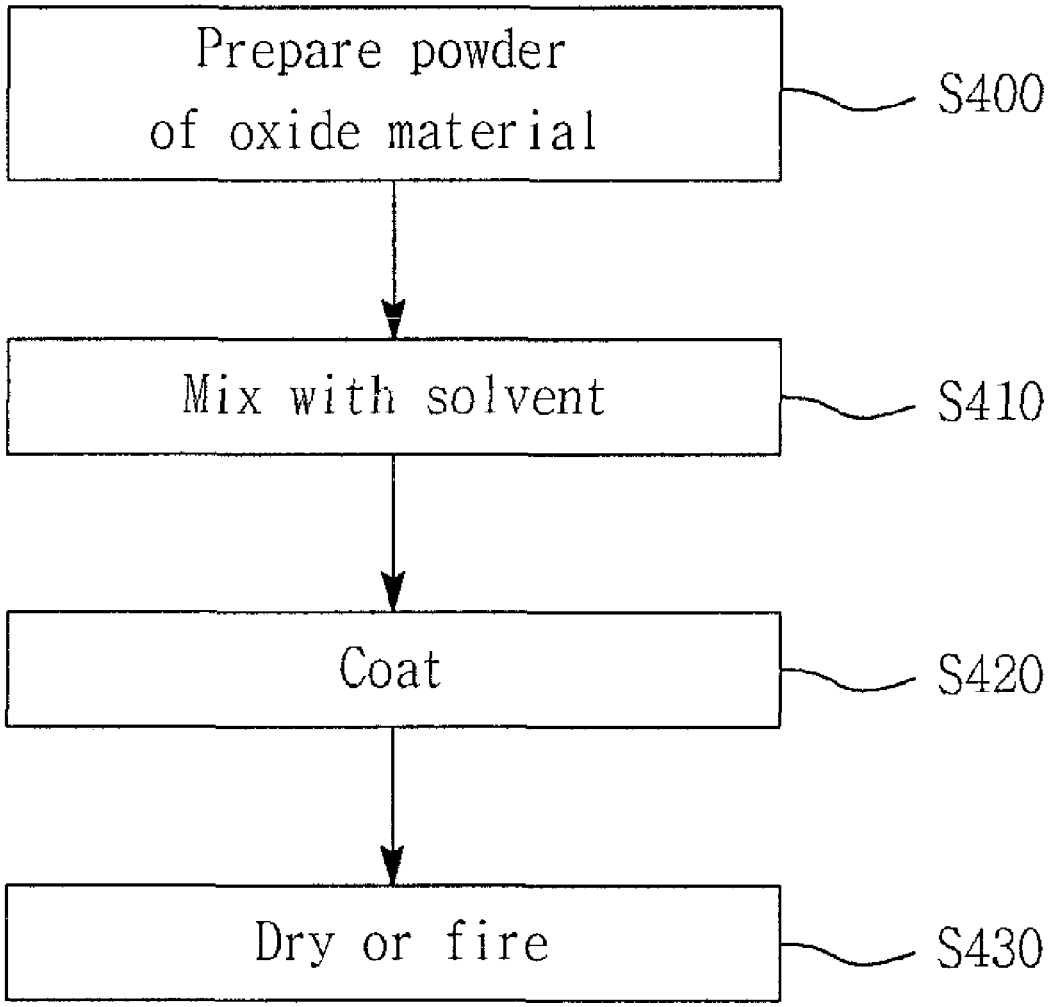
FIG. 13 illustrates an implementation of a method of manufacturing a phosphor layer.

FIG. 13 illustrates an implementation of a method of manufacturing a phosphor layer.

As illustrated in FIG. 13, first, a powder of an oxide material is prepared in step S400. For instance, a gas oxidation process is performed on Mg vapor generated by heating Mg to form a powder of MgO material.

Next, the prepared oxide power is mixed with a solvent in step S410. For instance, the resulting MgO powder is mixed with methanol to manufacture an oxide paste or an oxide slurry.

Subsequently, the oxide paste or slurry is coated on the phosphor layer in step S420. In this case, a viscosity of the oxide paste or slurry is adjusted so that the oxide particles are smoothly positioned between the phosphor particles.

Subsequently, a drying process or a firing process is performed in step S430. Hence, the solvent mixed with the oxide powder is evaporated to form the phosphor layer of FIG. 12.

Figure 14:
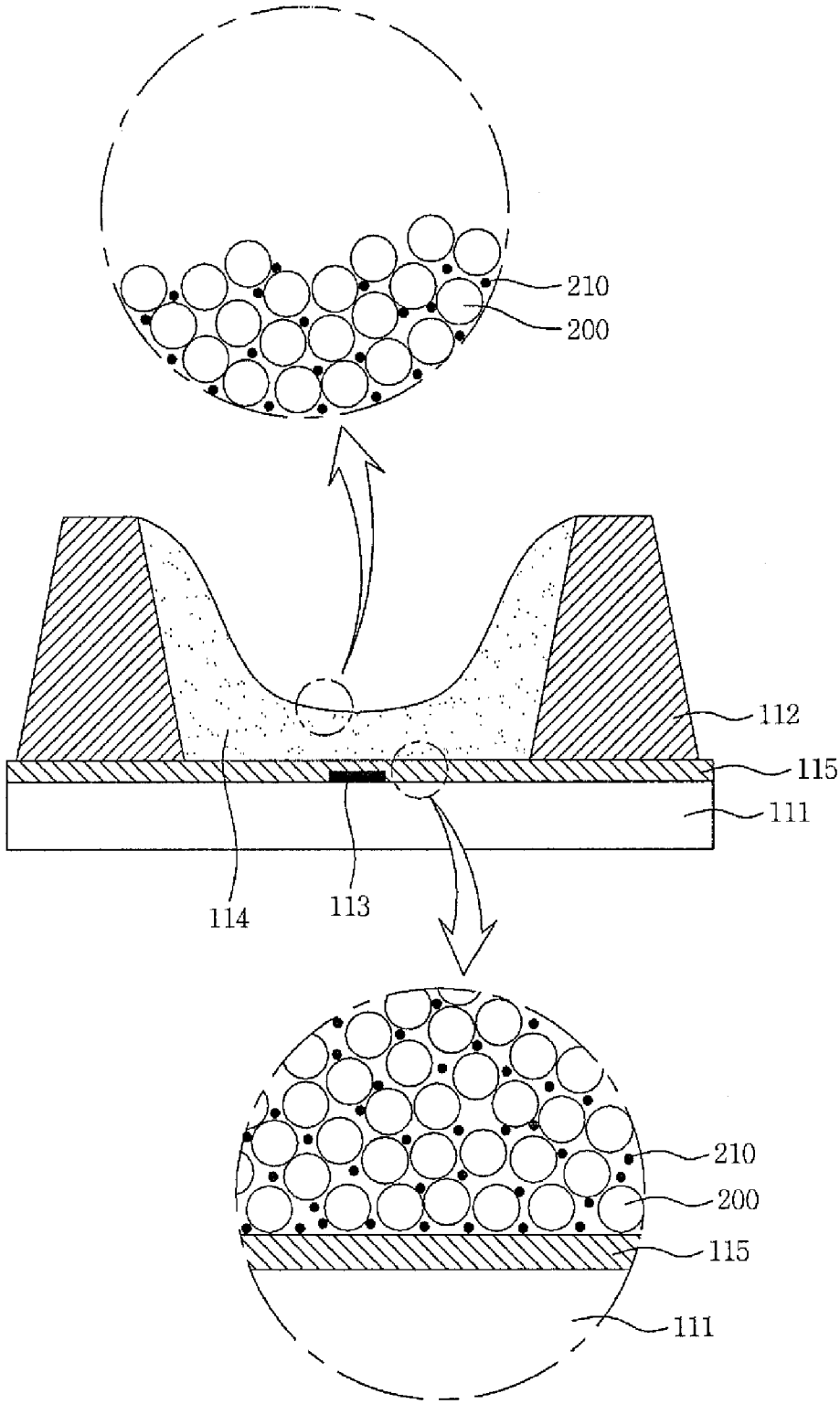
FIG. 14 illustrates another implementation of distribution of particles of an oxide material of a phosphor layer.

FIG. 14 illustrates another implementation of the distribution of particles of an oxide material of a phosphor layer.

As illustrated in FIG. 14, particles 210 of an oxide material may be positioned on the surface of the phosphor layer 114, inside the phosphor layer 114, and between the phosphor layer 114 and the lower dielectric layer 115.

Since the oxide particles 210 are positioned between the phosphor particles 200, a discharge response characteristic between the scan electrode and the address electrode or between the sustain electrode and the address electrode can be improved.

Figure 15:
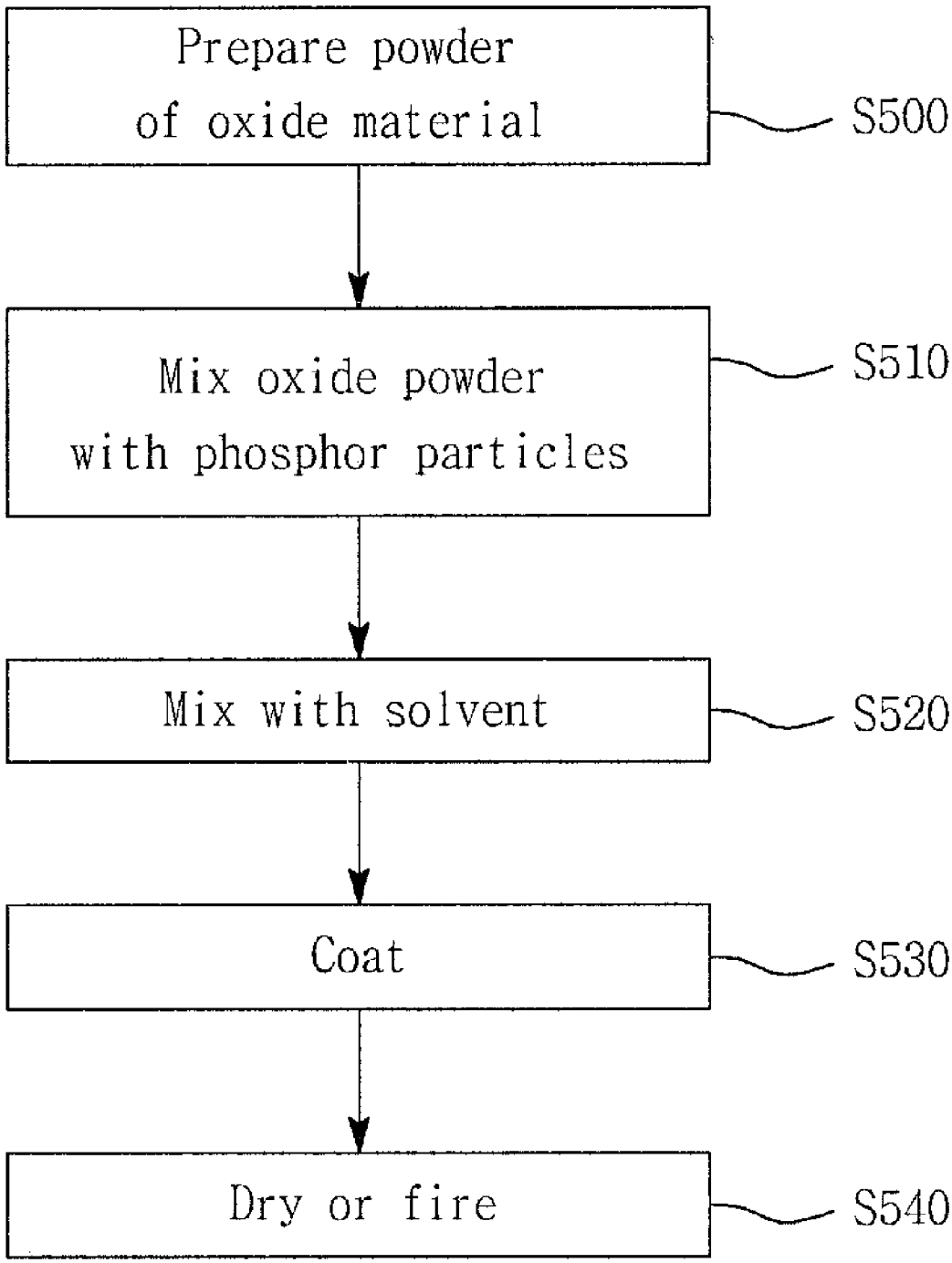
FIG. 15 illustrates another implementation of a method of manufacturing a phosphor layer.

FIG. 15 illustrates another implementation of a method of manufacturing a phosphor layer.

As illustrated in FIG. 15, a powder of an oxide material is prepared in step S500.

The prepared oxide power is mixed with phosphor particles in step S510.

The oxide power and the phosphor particles are mixed with a solvent in step S520.

The oxide power and the phosphor particles mixed with the solvent are coated inside the discharge cells in step S530. In this case, a dispensing method may be used.

A drying process or a firing process is performed in step S540 to evaporate the solvent. Hence, a phosphor layer with a structure illustrated in FIG. 14 is formed.

Figure 16A:
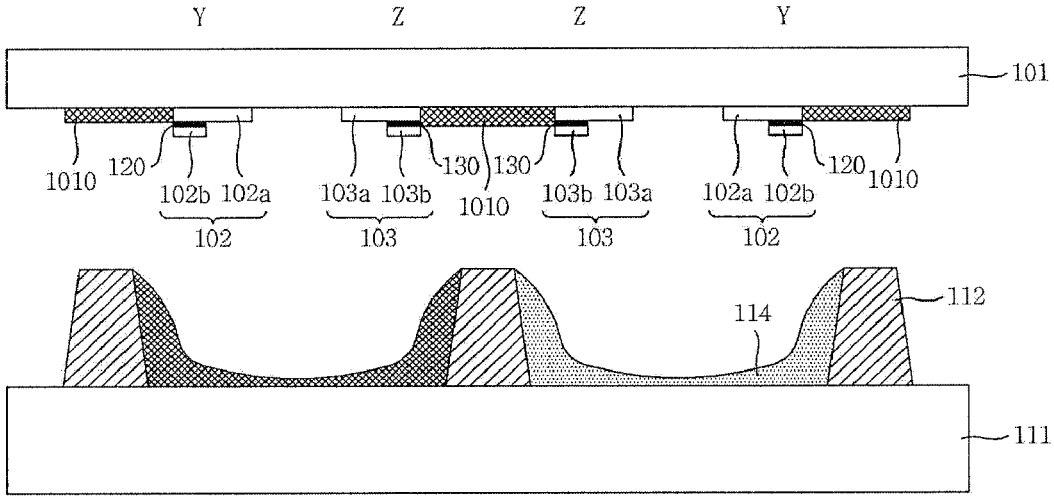
FIGS. 16A and 16B illustrate another structure of the plasma display panel according to the exemplary embodiment.
Figure 16B:
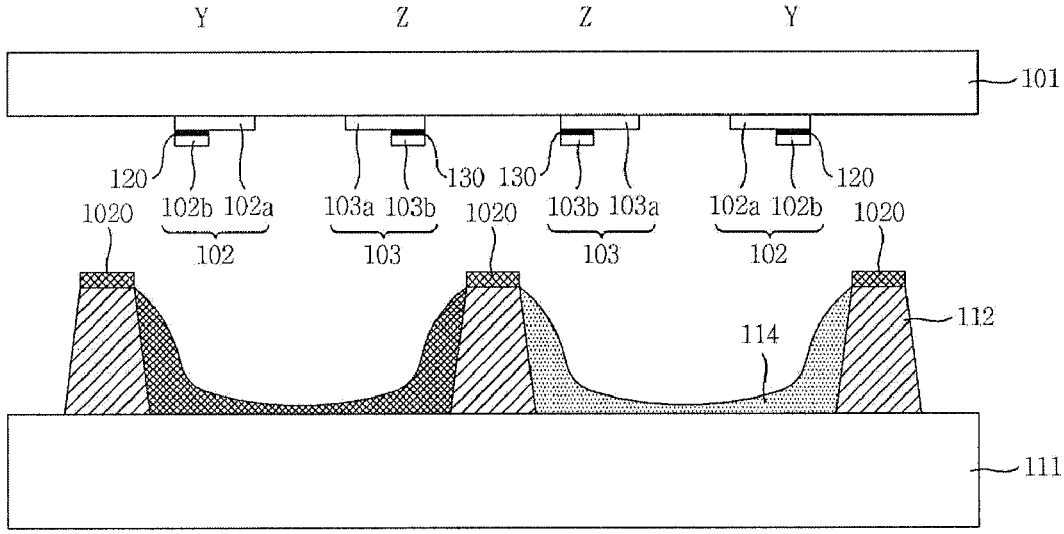

FIGS. 16A and 16B illustrate another structure of the plasma display panel according to the exemplary embodiment.

As illustrated in FIG. 16A, a black matrix 1010 overlapping the barrier rib 112 is positioned on the front substrate 101. The black matrix 1010 absorbs incident light, and thus suppresses the reflection of light caused by the barrier rib 112. Hence, a panel reflectance is reduced and a contrast characteristic can be improved.

In FIG. 16A, the black matrix 1010 is positioned on the front substrate 101. However, the black matrix 1010 may be positioned on the upper dielectric layer (not shown).

Black layers 120 and 130 are positioned between the transparent electrodes 102*a* and 103*a* and the bus electrodes 102*b* and 103*b*, respectively. The black layers 120 and 130 prevent the reflection of light caused by the bus electrodes 102*b* and 103*b*, thereby reducing a panel reflectance As illustrated in FIG. 16B, a top black matrix 1020 is formed on the barrier rib 112. Since the top black matrix 1020 reduces a panel reflectance, a black matrix may not be formed on the front substrate 101.

As described above, when the phosphor layer includes a pigment, the panel reflectance can be further reduced. For instance, the first phosphor layer may include a red pigment, and the second phosphor layer may include a blue pigment.

The black layers 120 and 130, the black matrix 1010 and the top black matrix 1020 may be omitted from the plasma display panel. Because the pigment mixed with the phosphor layer can sufficiently reduce the panel reflectance, a sharp increase in the panel reflectance can be prevented although the black layers 120 and 130, the black matrix 1010 and the top black matrix 1020 are omitted.

A removal of the black layers 120 and 130, the black matrix 1010 and the top black matrix 1020 can make a manufacturing process of the panel simpler, and reduce the manufacturing cost.

A width of at least one of the black matrix 1010 of FIG. 16A or the top black matrix 1020 of FIG. 16B may be smaller than an upper width of the barrier rib 112. In this case, an aperture ratio can be sufficiently secured and an excessive reduction in a luminance can be prevented.

Figure 17:
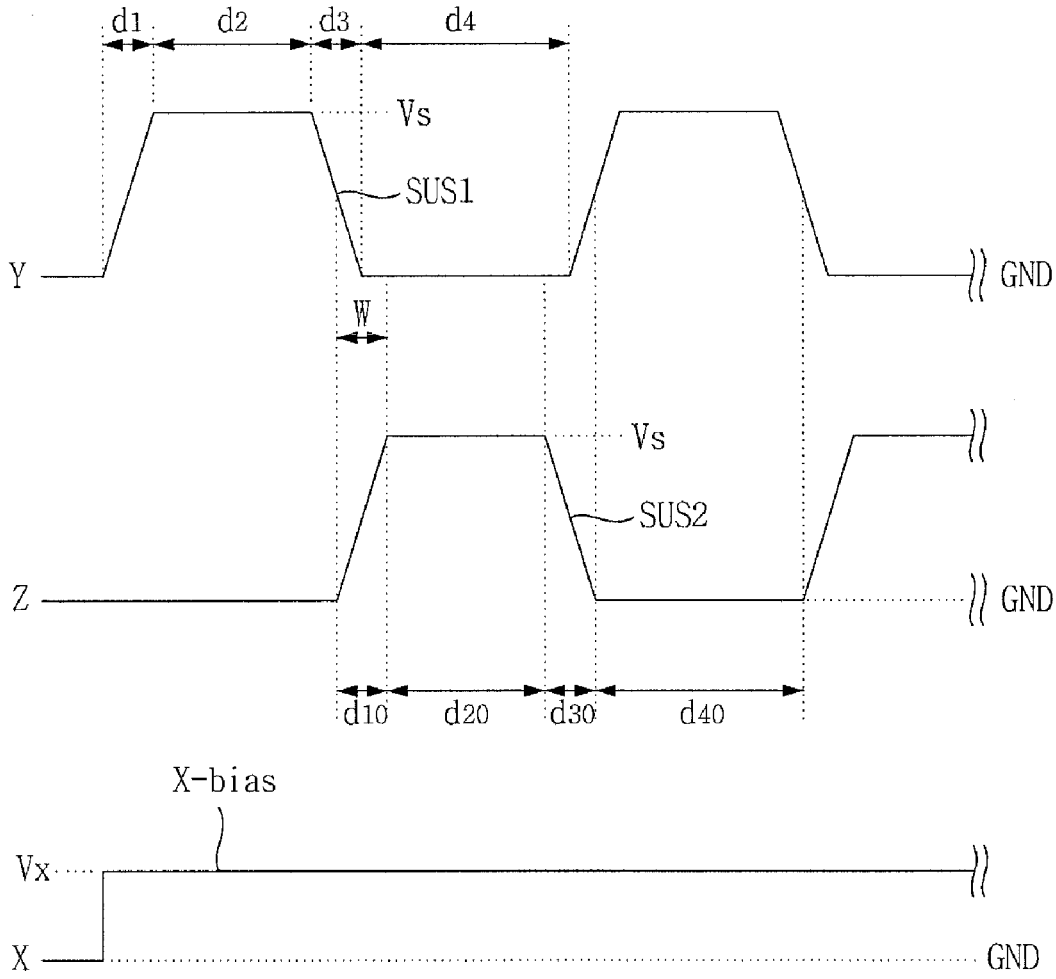
FIG. 17 is a diagram for explaining the overlap of sustain signals.

FIG. 17 is a diagram for explaining the overlap of sustain signals.

As illustrated in FIG. 17, a first sustain signal SUS1 and a second sustain signal SUS2 are alternately supplied to the scan electrode Y and the sustain electrode Z. The first sustain signal SUS1 and the second sustain signal SUS2 may overlap each other.

The first sustain signal SUS1 includes a voltage rising period d1, a first voltage maintenance period d2 during which the first sustain signal SUS1 is maintained at a highest voltage Vs, a voltage falling period d3, and a second voltage maintenance period d4 during which the first sustain signal SUS1 is maintained at a lowest voltage GND. The second sustain signal SUS2 includes a voltage rising period d10, a first voltage maintenance period d20 during which the second sustain signal SUS2 is maintained at a highest voltage Vs, a voltage falling period d30, and a second voltage maintenance period d40 during which the second sustain signal SUS2 is maintained at a lowest voltage GND. The voltage falling period d3 of the first sustain signal SUS1 may overlap the voltage rising period d10 of the second sustain signal SUS2.

When two successively applied sustain signals overlap each other, the number of sustain signals capable of being applied during a sustain period can increase. Hence, a luminance can be improved. Further, the overlap of the sustain signals can compensate for a reduction in a luminance caused by the pigment included in the phosphor layer.

An address bias signal X-Bias, which is maintained at a voltage Vx higher than the ground level voltage GND, is supplied to the address electrode X during the sustain period. Hence, a voltage difference between the scan electrode Y and the address electrode X and a voltage difference between the sustain electrode Z and the address electrode X can be reduced during the sustain period. Furthermore, a sustain discharge between the scan electrode Y and the sustain electrode Z can occur close to the front substrate. The efficiency of the sustain discharge can be improved and a degradation of the phosphor layer can be suppressed.

Figure 18:
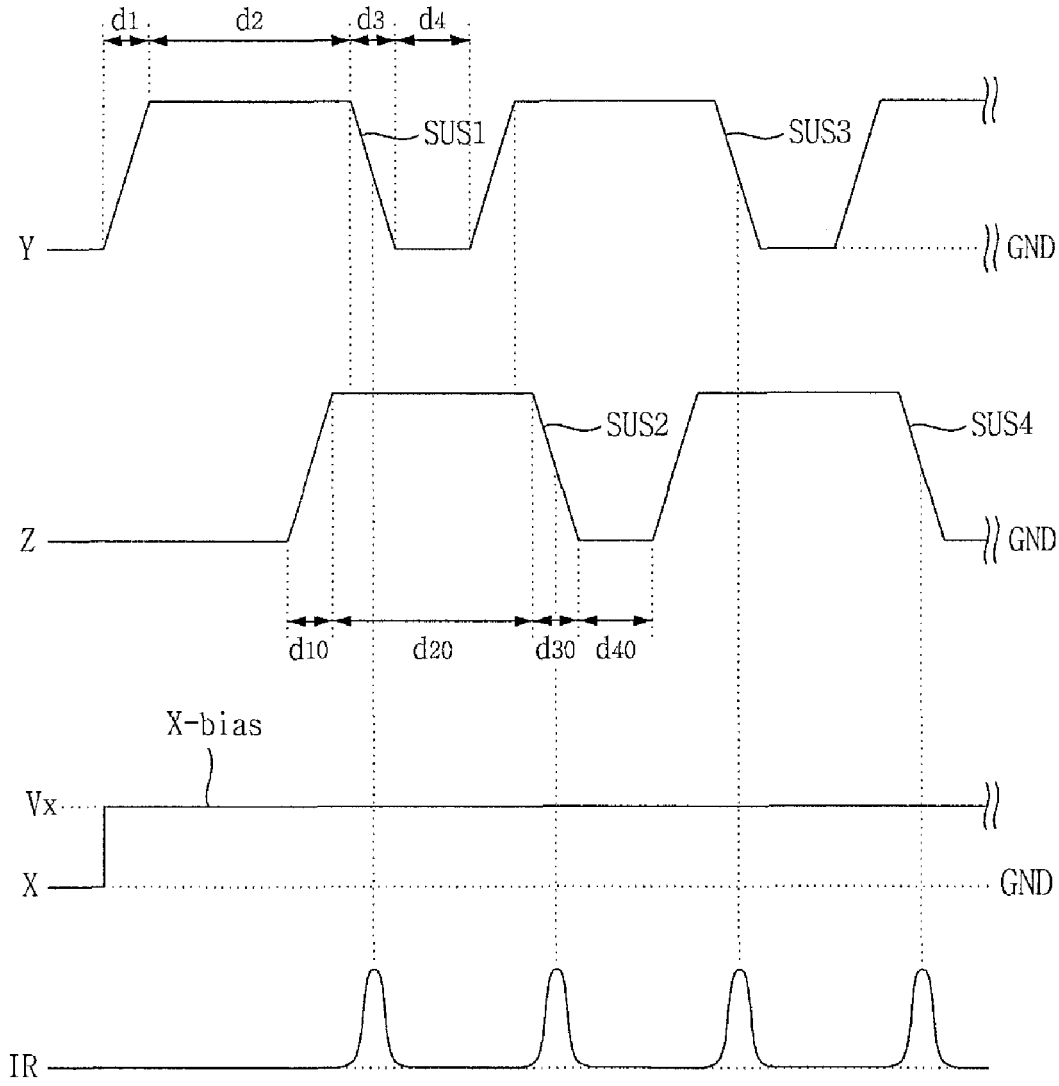
FIG. 18 is a diagram for explaining a first voltage maintenance period and a second voltage maintenance period.

FIG. 18 is a diagram for explaining a first voltage maintenance period and a second voltage maintenance period.

As illustrated in FIG. 18, the voltage falling period d3 of the first sustain signal SUS1 may overlap the first voltage maintenance period d20 of the second sustain signal SUS2.

A sustain discharge may occur due to an increase in a voltage difference between the scan electrode and the sustain electrode during the voltage falling periods d3 and d30 of the first and second sustain signals SUS1 and SUS2.

Further, a sustain discharge may occur due to an increase in a voltage difference between the scan electrode and the sustain electrode during the voltage rising periods d1 and d10 of the first and second sustain signals SUS1 and SUS2. In this case, a self-erase discharge may frequently occur due to electrons moving from the phosphor layer in a direction toward the scan electrode or the sustain electrode, and thus wall charges accumulated on the scan electrode or the sustain electrode may be erased. Hence, the sustain discharge may unstably occur due to the insufficient amount of wall charges. The self-erase discharge may more frequently occur due to an increase in an interference of the phosphor layer when an interval between the scan electrode and the sustain electrode is relatively wide, for instance, when an interval between the scan electrode and the sustain electrode is larger than a height of the barrier rib.

On the contrary, when a sustain discharge occurs due to an increase in the voltage difference between the scan electrode and the sustain electrode during the voltage falling periods d3 and d30, the sustain discharge occurs due to electrons moving from the scan electrode or the sustain electrode to a direction toward the phosphor layer. Hence, a self-erase discharge can be suppressed. The generation of the self-erase discharge can be suppressed although the interval between the scan electrode and the sustain electrode is larger than the height of the barrier rib.

As above, a time width of each of the first voltage maintenance periods d2 and d20 may be longer than a time width of each of the second voltage maintenance periods d4 and d40 so as to increase the voltage difference between the scan electrode and the sustain electrode during the voltage falling periods d3 and d30. Hence, the voltage falling period d3 can overlap the first voltage maintenance period d20, and thus sustain discharge can occur during the voltage falling period d3. Further, the self-erase discharge can be suppressed.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display panel comprising:

a front substrate;

a rear substrate positioned to be opposite to the front substrate;

a barrier rib that is positioned between the front substrate and the rear substrate and that partitions a discharge cell; and a phosphor layer positioned inside the discharge cell, the phosphor layer including a first phosphor layer for emitting red light, a second phosphor layer for emitting blue light, and a third phosphor layer for emitting green light, wherein the first phosphor layer includes a red pigment, at least one of the first phosphor layer, the second phosphor layer or the third phosphor layer includes magnesium oxide (MgO) material, and the second phosphor layer includes a blue pigment containing a Ni-based material, wherein when a content of the red pigment is 0.5 part by weight, a reflectance is equal to or less than about 50% at a wavelength of 400 nm to 550 nm measured when a light is directly irradiated on the barrier rib and the first phosphor layer in a state where the front substrate is removed, wherein the magnesium oxide (MgO) material is (111), (222), (444)-oriented MgO materials, and wherein when a content of the red pigment is 0.5 parts by weight and a content of the blue pigment is 1.0 parts by weight, a panel reflectance ranges from 27.5% to 29.5% at a wavelength of 500 nm to 600 nm measured in a panel state in which the front substrate and the rear substrate coalesce with each other.

2. The plasma display panel of claim 1, wherein a content of red pigment ranges from 0.01 to 5 parts by weight.

3. The plasma display panel of claim 1, wherein the red pigment includes an iron (Fe)-based material.

4. The plasma display panel of claim 1, wherein a content of blue pigment ranges from 0.01 to 5 parts by weight.

5. The plasma display panel of claim 1, wherein the blue pigment includes at least one of a cobalt (Co)-based material, a copper (Cu)-based material, and a chrome (Cr)-based material.

6. The plasma display panel of claim 1, wherein the third phosphor layer includes a green pigment.

7. The plasma display panel of claim 6, wherein a content of green pigment ranges from 0.01 to 3 parts by weight.

8. The plasma display panel of claim 6, wherein the green pigment includes a zinc (Zn)-based material.

9. The plasma display panel of claim 6, wherein a content of green pigment is less than a content of the red pigment.

10. The plasma display panel of claim 1, wherein a ratio of a particle size of the MgO material to a particle size of the first phosphor layer, the second phosphor layer or the third phosphor layer ranges from 0.005 to 1.

11. A plasma display panel comprising:

a front substrate;

a rear substrate positioned to be opposite to the front substrate;

a barrier rib that is positioned between the front substrate and the rear substrate and that partitions a discharge cell; and a phosphor layer positioned inside the discharge cell, the phosphor layer including a phosphor material, a pigment and a magnesium oxide (MgO) material, wherein at least one of particles of the phosphor material is exposed on a surface of the phosphor layer in a direction toward the discharge cell, wherein the phosphor layer includes a first phosphor layer for emitting red light, a second phosphor layer for emitting blue light, and a third phosphor layer for emitting green light, and the first phosphor layer includes a red pigment, and the second phosphor layer includes a blue pigment containing a Ni-based material, wherein when a content of the red pigment is 0.5 part by weight, a reflectance is equal to or less than about 50% at a wavelength of 400 nm to 550 nm measured when a light is directly irradiated on the barrier rib and the first phosphor layer in a state where the front substrate is removed, wherein the magnesium oxide (MgO) material is (111), (222), (444)-oriented MgO materials, and wherein when a content of the red pigment is 0.5 parts by weight and a content of the blue pigment is 1.0 parts by weight, a panel reflectance ranges from 27.5% to 29.5% at a wavelength of 500 nm to 600 nm measured in a panel state in which the front substrate and the rear substrate coalesce with each other.

12. The plasma display panel of claim 11, wherein at least one of the first phosphor layer, the second phosphor layer or the third phosphor layer includes MgO material.

13. The plasma display panel of claim 11, wherein particles of the MgO material are positioned either on the surface of the phosphor layer, inside the phosphor layer, or between the phosphor layer and a lower dielectric layer.

14. The plasma display panel of claim 11, wherein the red pigment includes an iron (Fe)-based material.

15. The plasma display panel of claim 11, wherein a content of the blue pigment ranges from 0.01 to 5 parts by weight.

16. The plasma display panel of claim 11, wherein the blue pigment includes at least one of a cobalt (Co)-based material, a copper (Cu)-based material, and a chrome (Cr)-based material.

17. The plasma display panel of claim 11, wherein the third phosphor layer includes a green pigment.

18. The plasma display panel of claim 17, wherein a content of the green pigment ranges from 0.01 to 3 parts by weight.

19. The plasma display panel of claim 17, wherein the green pigment includes a zinc (Zn)-based material.

20. A plasma display panel comprising:

a rear substrate;

a barrier rib that is positioned on the rear substrate and that partitions a discharge cell; and a phosphor layer positioned inside the discharge cell, the phosphor layer including a first phosphor layer for emitting red light, a second phosphor layer for emitting blue light, and a third phosphor layer for emitting green light, wherein the first phosphor layer includes a red pigment, and at least one of the first phosphor layer, the second phosphor layer or the third phosphor layer includes magnesium oxide (MgO) material, and the second phosphor layer includes a blue pigment containing a Ni-based material, wherein when a content of the red pigment is 0.5 part by weight, a reflectance is equal to or less than about 50% at a wavelength of 400 nm to 550 nm measured when a light is directly irradiated on the barrier rib and the first phosphor layer in a state where the plasma display panel is provided without a front substrate positioned to be opposite to the front substrate, wherein the magnesium oxide (MgO) material is (111), (222), (444)-oriented MgO materials, and wherein when a content of the red pigment is 0.5 parts by weight and a content of the blue pigment is 1.0 parts by weight, a panel reflectance ranges from 27.5% to 29.5% at a wavelength of 500 nm to 600 nm measured in a panel state in which the front substrate and the rear substrate coalesce with each other.

* * * * *